US007175975B2

(12) United States Patent
Singer et al.

(10) Patent No.: US 7,175,975 B2
(45) Date of Patent: Feb. 13, 2007

(54) PHOTOGRAPHIC MATERIAL WITH IMPROVED DEVELOPMENT INHIBITOR RELEASES

(75) Inventors: Stephen P. Singer, Spencerport, NY (US); Christopher Grote, St. Louis, MO (US); Robert C. Stewart, Spencerport, NY (US); John W. Harder, Rochester, NY (US); David S. Ross, Rochester, NY (US); Janet N. Younathan, Fairport, NY (US); Louis Elbert Friedrich, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 26 days.

(21) Appl. No.: 11/211,937

(22) Filed: Aug. 25, 2005

(65) Prior Publication Data

US 2006/0008751 A1 Jan. 12, 2006

Related U.S. Application Data

(63) Continuation of application No. 10/844,858, filed on May 13, 2004, now abandoned.

(51) Int. Cl.

| | |
|---|---|
| ***G03C 1/46*** | (2006.01) |
| ***G03C 1/08*** | (2006.01) |
| ***G03C 7/26*** | (2006.01) |
| ***G03C 7/32*** | (2006.01) |

(52) U.S. Cl. ..... 430/505; 430/502; 430/503; 430/506; 430/544; 430/553; 430/955; 430/957

(58) Field of Classification Search ..... 430/502, 430/503, 505, 506, 544, 553, 955, 957
See application file for complete search history.

(56) References Cited

U.S. PATENT DOCUMENTS

| | | | |
|---|---|---|---|
| 4,482,629 | A | 11/1984 | Nakagawa et al. |
| 4,690,889 | A | 9/1987 | Saito et al. |
| 4,883,746 | A | 11/1989 | Shimada et al. |
| 5,112,730 | A | 5/1992 | Ohkawa et al. |
| 5,463,072 | A | 10/1995 | Bergthaller |
| 6,107,016 | A | 8/2000 | Ito et al. |
| 6,194,131 | B1 | 2/2001 | Ito et al. |
| 6,437,169 | B1 | 8/2002 | Ito et al. |

FOREIGN PATENT DOCUMENTS

| | | | |
|---|---|---|---|
| DE | 3635391 | A1 | 10/1986 |
| EP | 0 161 6626 | | 12/1990 |
| EP | 0 307 927 | B1 | 6/1994 |
| EP | 0 572 887 | B1 | 11/1999 |
| JP | 2003-075970 | | 3/2003 |

OTHER PUBLICATIONS

U.S. Appl. No. 10/844,904 (D-87514), filed herewith, titled 2-Halonapthol Couplers), by Harder et al.
DE Abstract 3635391.
JP Abstract 07-140606.
JP Abstract 07-281371.
JP Abstract 08-320541.
JP Abstract 2000-171933.
JP Abstract 2001-163847.
JP Abstract 2002-006456.
Research Disclosure (1988), item 290 367-70.

*Primary Examiner*—Geraldine Letscher
(74) *Attorney, Agent, or Firm*—Sarah Meeks Roberts

(57) ABSTRACT

This invention relates to a multilayer silver halide photographic element, generally processed with phenylenediamine based developer solutions, comprising a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler, wherein at least one layer additionally contains a 2-substituted-5-amino-1-napthol DIR according to Formula (I):

Formula (I)

wherein:

X is chosen from among hydrogen, halogen atoms, an alkyl group with 6 carbon atoms or less or a N-substituted carbamoyl group where the N substituent is either an alkyl group with 6 carbon atoms or less or an aryl group with 8 total carbon atoms or less;

R is a carbonyl or sulfonyl group; and

INH is an inhibitor of silver development.

It has been found that such 2-substituted-5-amino-1-napthol based DIRs have improved properties and can provide a conventional silver halide photographic element with excellent image structure and color reproduction.

19 Claims, No Drawings

PHOTOGRAPHIC MATERIAL WITH IMPROVED DEVELOPMENT INHIBITOR RELEASES

CROSS-REFERENCE TO RELATED APPLICATIONS

This is a Continuation of U.S. Ser. No. 10/844,858 filed May 13, 2004 now abandoned.

FIELD OF THE INVENTION

This invention relates to a conventional silver halide photographic material containing at least one light sensitive silver halide emulsion and a development inhibitor releasing coupler that is derived from an improved type of 2-substituted 5-amino-1-napthol. The invention is directed in particular to a color photographic material with improved image structure with excellent color reproduction that is processed using standard phenylenediamine based color developers.

BACKGROUND OF THE INVENTION

It is well known in the photographic art to use compounds that upon reaction with oxidized developer, release inhibitors of silver development. This not only controls tone scale (the amount of density produced for the amount of light exposure) but also can lead to substantial improvements in image structure and color reproduction. Grain and granularity are improved by allowing for partial grain development so that more centers can be obtained. Acutance and sharpness are improved by the well-known masking effect caused by interlayer inhibitor diffusion. Color reproduction is improved via interlayer diffusion of the inhibitor via reduced development in one color record as a function of the amount of exposure in another.

Many different types of development inhibitor releasing compounds that rely on coupling reactions with oxidized developer (Dox) are known. In general, those that release the inhibitor directly upon reaction with Dox and have the inhibitor fragment directly bonded to the Dox reaction site are referred to as DIRs (development inhibitor releasers). Those materials that release the inhibitor indirectly and have an unstable intermediate group between coupling site and the inhibitor fragment are generally referred to as DIARs (development inhibitor assisted releasers). These unstable intermediate groups are typically referred to as timing or switching groups and delay the introduction of the free inhibitor moiety. Each of these types of image modifier has advantages and disadvantages and the choice is usually determined by the requirements of the particular film element.

2-Substituted-5-amino-1-napthol derivatives are well known in the photographic art as cyan couplers. For example, see U.S. Pat. Nos. 4,690,889, 4,883,746, EP 307, 927B1 and Research Disclosure (1988), 290 367–70. It is well known to use this type of coupler to release PUGs (photographically useful groups) upon reaction with oxidized developer. For example, see U.S. Pat. No. 5,112,730. In particular, it is known to use this type of coupler to release inhibitors of silver development. For example, see EP 161, 626, EP 572,887 and DE 3,635,391.

In general, the nature of the 2-substituent in these 5-amino-1-napthol compounds is widely disclosed and not limited to any particular type. However, it is commonly found that 2-carbamoyl groups are often useful and in particular, N-alkyl-2-carbamoyl groups, where the N-alkyl contains a sufficient number of atoms to limit diffusion of the coupler and subsequently formed cyan dye within the photographic film, are desirable.

JP08320541 A2 describes 2-N-arylcarbamoyl-5-amino-1-napthol couplers where the N-aryl contains an ortho-alkyloxy group in addition to other alkyl or alkyloxy groups. JP2001163847A2 describes the preparation of a wide number of 2-N-arylcarbamoyl-5-amino-1-napthol couplers. JP07140606 and JP07036158 describe a 2-N-(4-sulfamoylphenyl)carbamoyl-5-amino-1-napthol that indirectly releases an inhibitor of silver development via a timing group.

JP2003075970 and JP2000171933 describe the use of 2-chloro-5-amino-1-napthol derivatives, among others, for use in thermally developable imaging systems. JP07281371 describes the use of various 2-(N-alkyl, aryl and unsubstituted)carbamoyl-5-amino-1-napthols as cyan image couplers. JP07287367 describes the use of similar 2-(N-unsubstituted)carbamoyl couplers for the same purpose.

U.S. Pat. Nos. 6,107,016, 6,194,131, 6,437,169 and JP2002006456 all describe the use of 2-substituted-5-amino-1-napthols where the 5-amino group is substituted with an inhibitor of silver developer such that the inhibitor can be released via an intramolecular cyclization upon reaction with oxidized developer. Such materials do not form permanent cyan dyes.

In conventional photographic systems using a color negative origination material and a color print material, the dye formed from the cyan coupler used in the negative typically has a maximum absorbtivity at approximately 690 nm where the print has maximum red light sensitivity. However, for some purposes, it may be desirable to form cyan dyes in the negative that are substantially hypsochromic of 690 nm and closer to where the human eye perceives red light (~610–640 nm). Known 2-substituted-5-amino-1-napthol derived dyes for color negative films typically have maximum absorbance at ~690 nm.

Despite a large number of attempts to provide DIRs with desirable photographic performance, there still remains a need for DIRs with improved properties. The problem remains to provide a conventional silver halide photographic element having the desired tone scale with improved image structure and excellent color reproduction.

SUMMARY OF THE INVENTION

In one embodiment this invention provides a multilayer silver halide photographic element, generally processed with phenylenediamine based developer solutions, comprising a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler, wherein at least one layer additionally contains a 2-substituted-5-amino-1-napthol DIR according to Formula (I):

Formula (I)

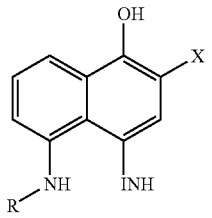

wherein:

X is chosen from among hydrogen, halogen atoms, an alkyl group with 6 carbon atoms or less or a N-substituted carbamoyl group where the N substituent is either an alkyl group with 6 carbon atoms or less or an aryl group with 8 total carbon atoms or less;

R is a carbonyl or sulfonyl group; and

INH is an inhibitor of silver development.

It has been found that such 2-substituted-5-amino-1-napthol based DIRs have improved properties and can provide a conventional silver halide photographic element with excellent image structure and color reproduction.

DETAILED DESCRIPTION OF THE INVENTION

The invention is generally as described above. Typically, the color silver halide photographic element useful in the present invention comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. Such elements are processed generally using phenylenediamine based developers. It is preferred that the color silver halide elements are negative working silver halide elements. It is also preferred that the silver halide photographic elements are capture or origination elements such as a color negative film or a motion picture origination film.

The compounds of Formula (I) of the invention are DIRs; that is, they have an inhibitor of silver development (INH) directly attached to the 4 position of the napthol ring (the site of reaction with Dox). There are no unstable intermediate groups between the napthol and the inhibitor fragment and free INH is directly produced upon reaction with Dox. INH can be any known class of inhibitors of silver development. These are generally heterocyclic compounds and include among others; triazoles, oxadiazoles, thiadiazoles, oxathiazoles, benzotriazoles, tetrazoles, mercaptotetrazoles, selenotetrazoles, mercaptothiadiazoles, mercaptotriazoles, mercaptooxadiazoles, telleurotetrazoles, benzisodiazoles, thioureas, purines and other tetraazaindenes. Of these, preferred INH are those that contain a thiol group including mercaptotetrazoles, mercaptothiadiazoles, mercaptotriazoles and mercaptooxadiazoles. Particularly useful are mercaptotetrazoles. In addition, deactivating or self-destructing inhibitors that bear a hydrolyzable group such as those described in U.S. Pat. Nos. 4,782,012; 5,200,306 and DE3209486A1, said descriptions incorporated herein by reference, are also highly desirable. Typically, the hydrolyzable group in such self-destructing inhibitors are ester groups that react with some component of the developer solution such as hydroxy ion or hydroxylamine to form the corresponding carboxylic acid substituted inhibitor that is much less effective at silver inhibition. Particularly suitable are those compounds where the self-destructing inhibitor fragment is a mercaptotetrazole.

In the DIR of Formula (I), the group R is a carbonyl (>C═O) or sulfonyl (—$SO_2$—) group. When R is a carbonyl group, it is preferred that it have the structure —C(═O)—$(Q)_n$-T where Q represents either an oxygen or nitrogen atom, n is zero or 1 and T is an alkyl or aryl group. When R is a sulfonyl group, it is preferred to have the structure —$SO_2$-T where T is defined as above. It is highly desirable that R is a ballast; that is, a group that contains sufficient size and bulk to substantially prevent diffusion of the entire molecule in the film element. To this end, R should contain a total of at least 8 carbon atoms, preferable at least 10 carbon atoms or most preferably at least 12 carbon atoms. Water-solubilizing groups such as hydroxy or carboxy may be present as part of the ballast so long as the overall bulk is still sufficient to prevent diffusion of the molecule. R is stable during processing, does not undergo any direct reactions with Dox nor releases any group such as an inhibitor fragment.

In the DIR of Formula (I), X must be chosen from among hydrogen, halogen atoms, an alkyl group with 6 carbon atoms or less or a N-substituted carbamoyl group where the N substituent is either an alkyl group with 6 carbon atoms or less or an aryl group with 7 carbon atoms or less. The halogen atoms can be fluorine, chlorine, bromine or iodine with chlorine being the most preferred. If X is an alkyl group, it must have 6 carbon atoms or less and can be branched or straight-chained and may be optionally substituted. The most preferred is methyl. If X is a carbamoyl group (—C(═O)—N<), it preferably has the structure —C(═O)—NH—Z where Z is hydrogen, an alkyl group with 6 carbon atoms or less or an aryl group with 8 total carbon atoms or less. When Z is an alkyl group, it can be branched or straight-chained and may be optionally substituted. The most preferred are hydrogen, methyl, —$CH_2CH_2CO_2H$ or —$CH_2CH_2CO_2$-alkyl where alkyl has 4 carbon atoms or less. When Z is an aryl group, it may be substituted with a group containing no more than 1 carbon atom such as methyl, methoxy or carboxy. The most preferred aryl group is ortho-methoxyphenyl.

A preferred form of the DIR of Formula (I) is shown in Formula (Ia):

Formula (Ia)

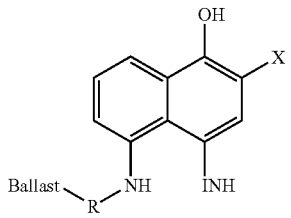

where R, X and INH are as defined for Formula (I) and Ballast is a group of sufficient size and bulk to prevent diffusion of the entire molecule in the film element.

A more preferred form for the DIR of the invention is shown in Formula (Ib):

Formula (Ib):

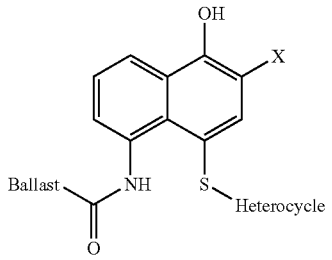

where X and Ballast are as defined for Formula (Ia) and Heterocycle represents a heterocyclic ring such as, for example, tetrazole, triazole, thiadiazole or oxadiazole such that the entire released fragment is an thiol substituted inhibitor of silver development such as mercaptotetrazole, mercaptotriazole, mercaptothiadiazole or mercaptooxadiazole.

The most preferred form of the DIR of the invention is according to Formula (Ic):

Formula (Ic)

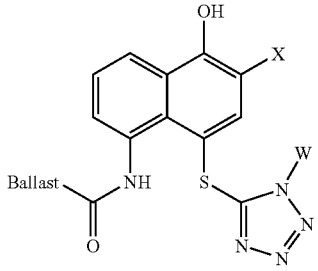

where X and Ballast are defined as above and W is an alkyl or aryl group. If W in alkyl group, it is preferred that it contain a hydrolyzable ester group. Some examples are —$CH_2$—$CO_2C_3H_7$-n, —$CH_2$—$CO_2C_4H_9$-n or —$CH_2CH_2CO_2C_2H_5$. Preferred aryl groups for W are phenyl, para-hydroxyphenyl and meta-acetamidophenyl. In Formula (Ic), the most preferred groups for X are chloro, methyl, carbamoyl (—$CONH_2$) and N-(ortho-methoxyphenyl)carbamoyl.

The following are some examples of the 5-amino-1-napthol DIR compounds used in the invention:

DIR-1:

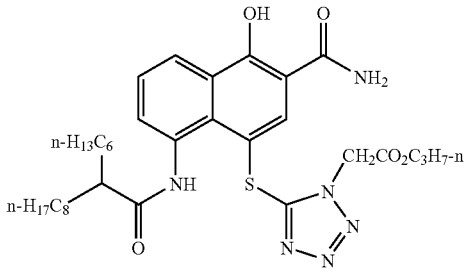

DIR-2:

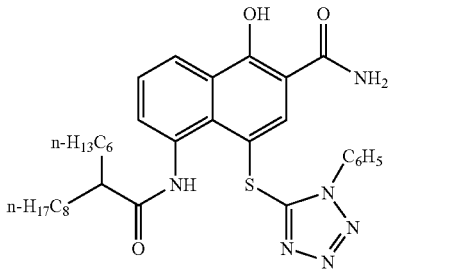

DIR-3:

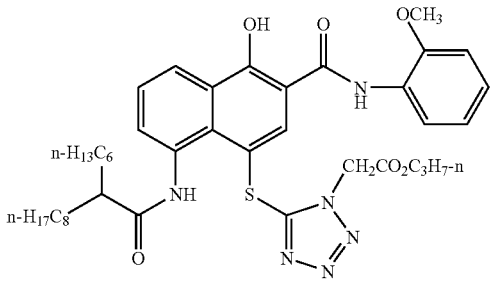

-continued
DIR-4:
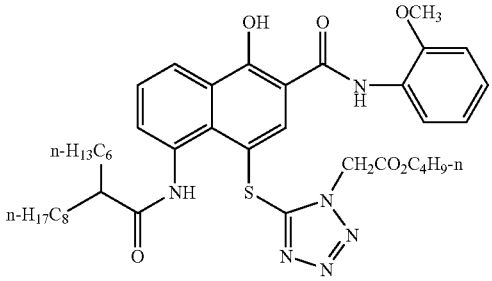
DIR-5:
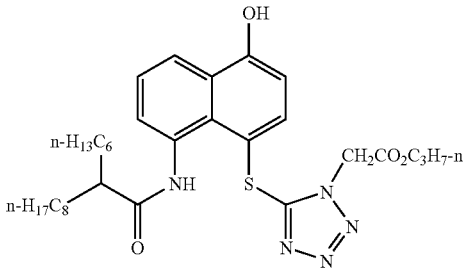
DIR-6:
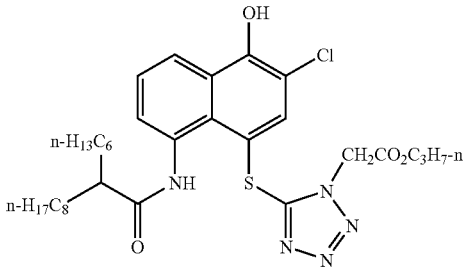
DIR-7:
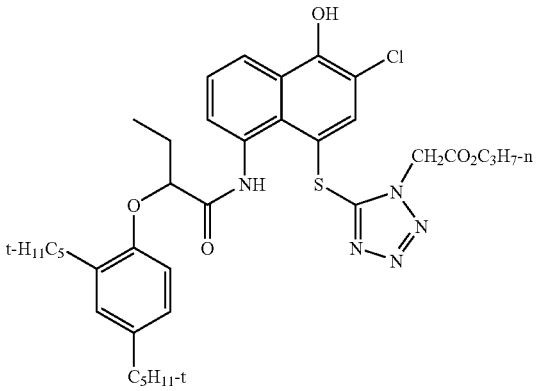
DIR-8:
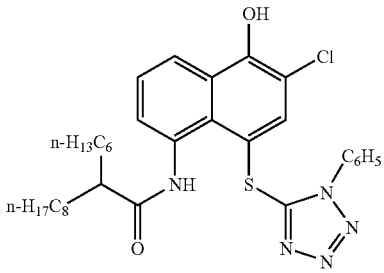

-continued
DIR-9:
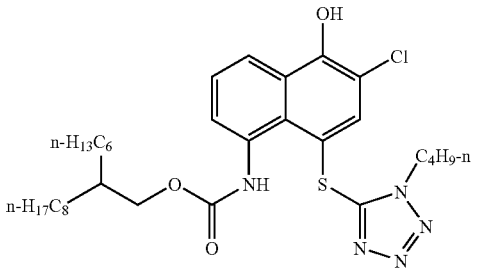
DIR-10:
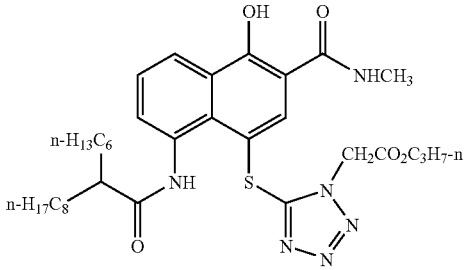
DIR-11:
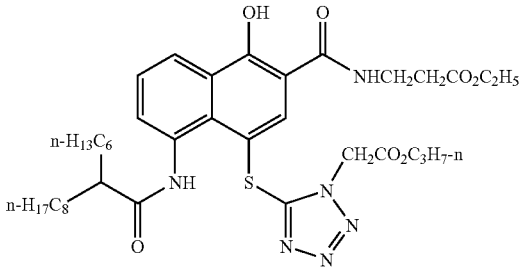
DIR-12:
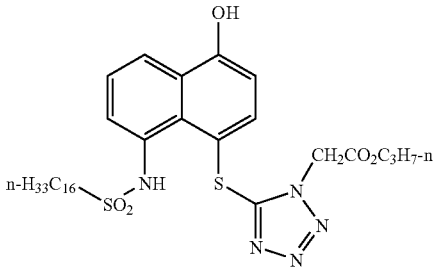
DIR-13:
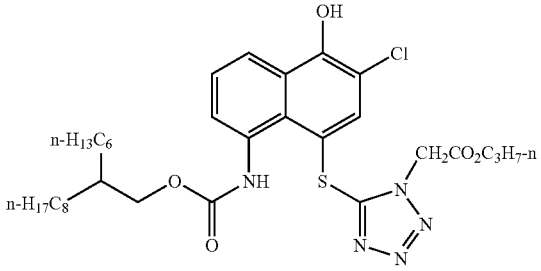

-continued
DIR-14:
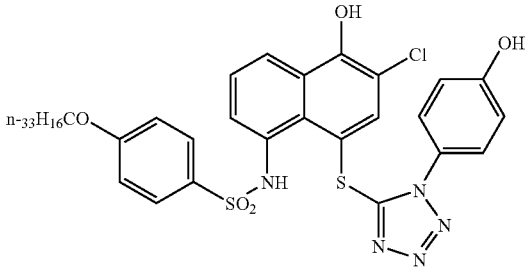
DIR-15:
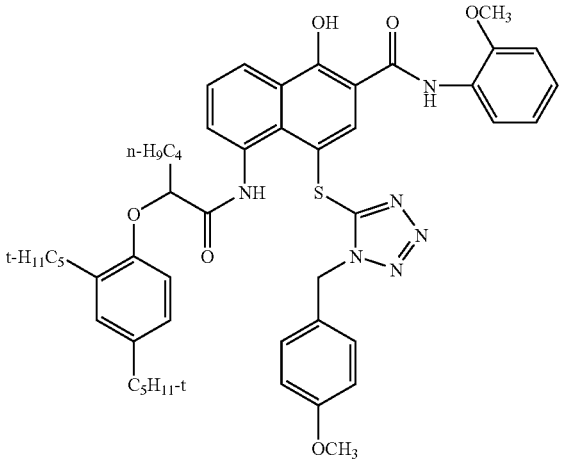
DIR-16:
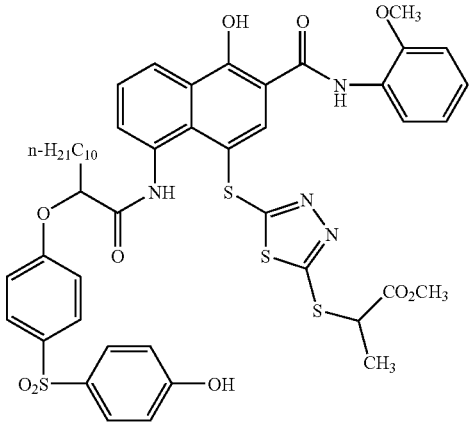
DIR-17:
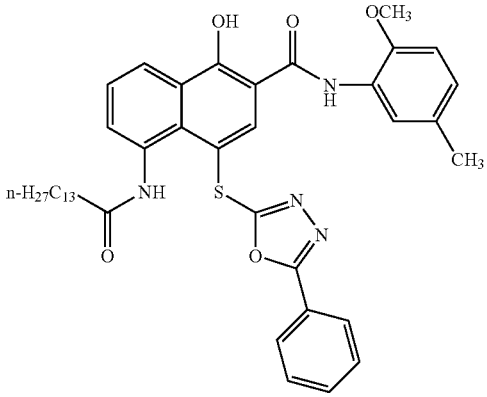

-continued
DIR-18:
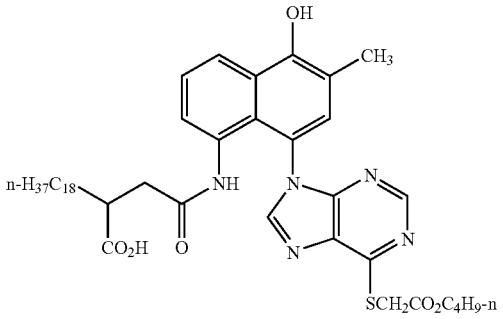
DIR-19:
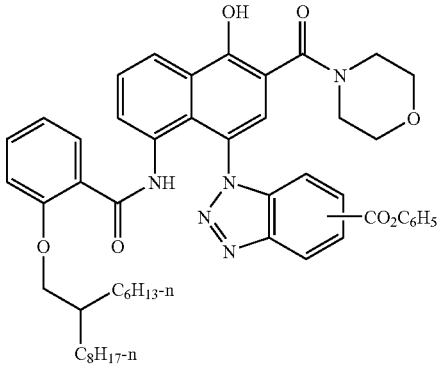
DIR-20:
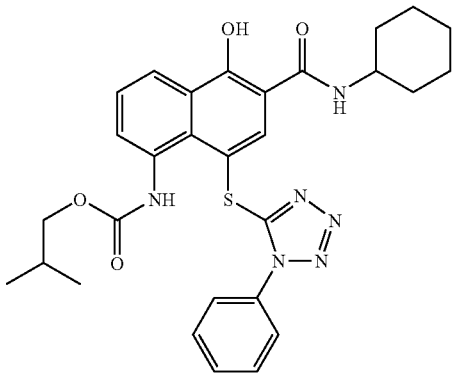
DIR-21:
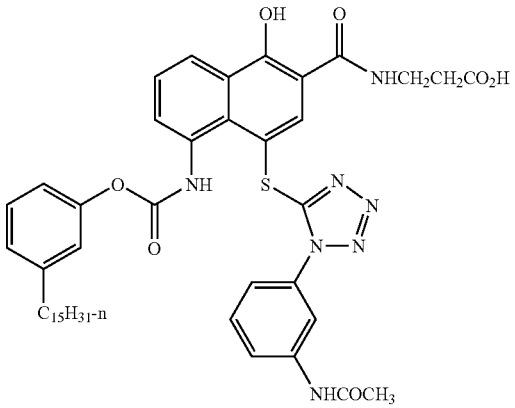

-continued

DIR-22:

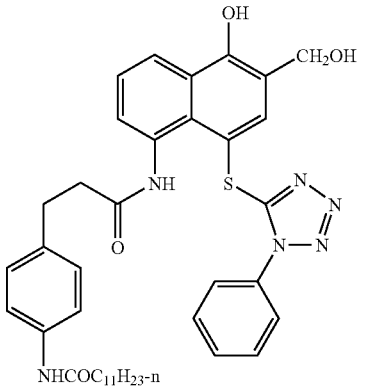

DIR-23:

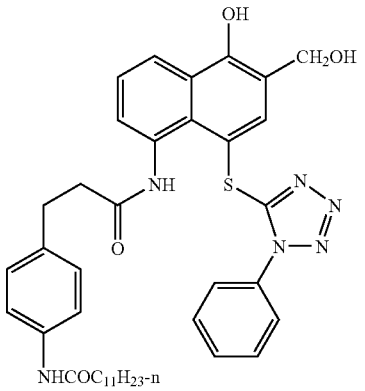

DIR-24:

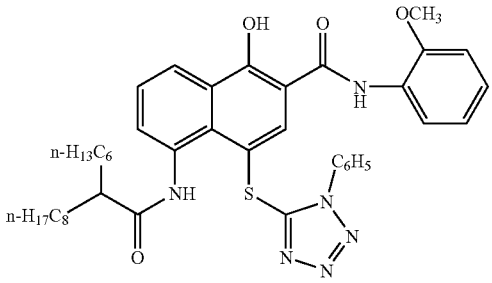

For the DIR compounds, it should be appreciated that the amount used is a function of other variables such as the location and number of layers in which the compound is located, the solvent used, film dimensions, the nature of the INH used and the magnitude of the improvements desired. Typically, the compounds are used in either an imaging or non-imaging layer in the range of 0.001 to 1 g/m$^2$ or more preferably, 0.01 to 0.1 g/m$^2$.

The DIR compounds may be added to or contained in any layer of the photographic element where they are in reactive association with the silver halide emulsion. By "in reactive association with" it is meant that the compounds must be contained in the silver halide emulsion layer or in a layer whereby they can react or interact with, or come in contact with the silver halide emulsion. For example, the compounds can also be added to gelatin-only overcoats or interlayers. In one embodiment the DIR is contained in the silver halide emulsion layer. In another embodiment the DIR compound is located in a layer adjacent to an imaging layer, particularly in a non-light sensitive layer adjacent to the silver halide emulsion layer.

The DIRs of the invention are preferably used in red light sensitive silver halide emulsion layers or in non-light sensitive layers adjacent to a red light sensitive silver halide emulsion layer. When there are multiple layers with different degrees of red-light sensitivity present, they may be used in any layer or layers in combination. It is preferred that the DIRs of the invention are used in the most red-light sensitive layer when two or more layers of differing red-light sensitivity are present. It is also possible to use the DIRs of the invention in conjunction with other types of known DIRs and DIARS, either in the same layer or in different layers.

The DIRs of the invention are particularly useful when used in combination with any of the following cyan image couplers:

C-1:
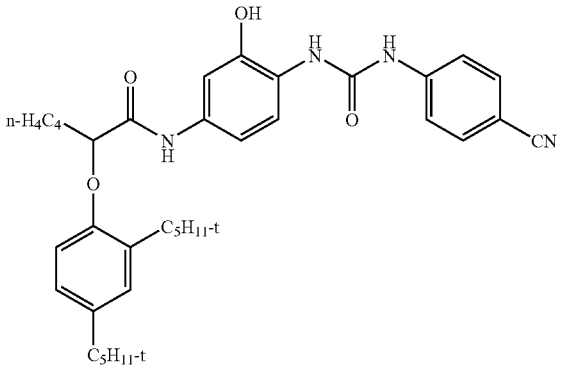
C-2:
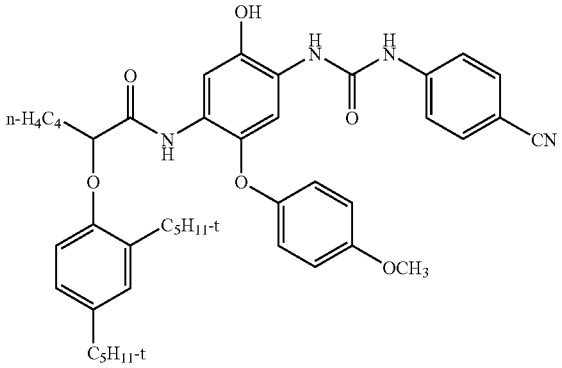
C-3:
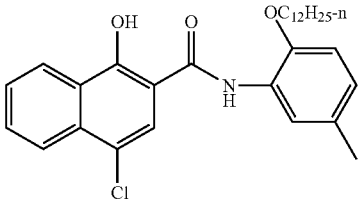
C-4:
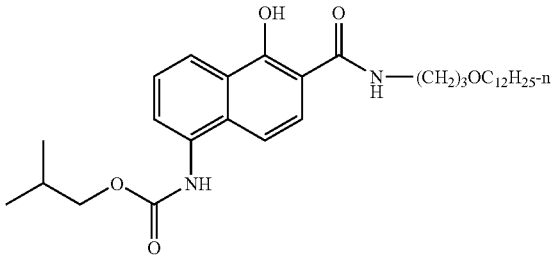
C-5:
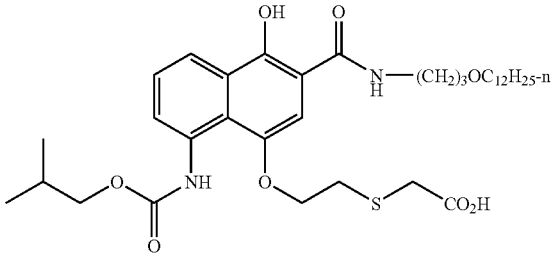

-continued

C-6:

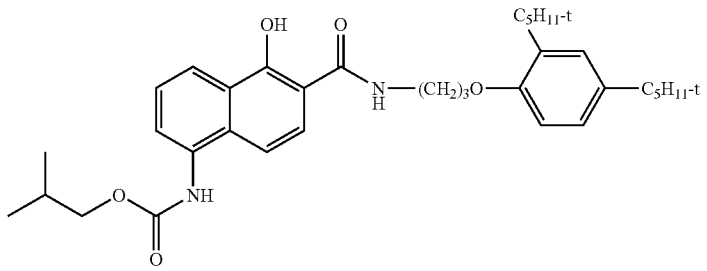

C-7:

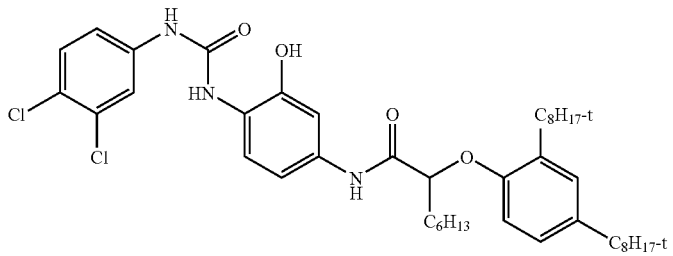

C-8:

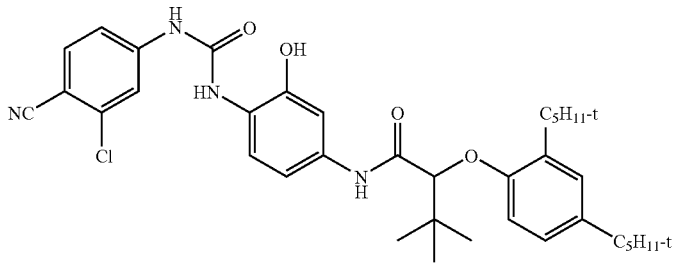

C-9:

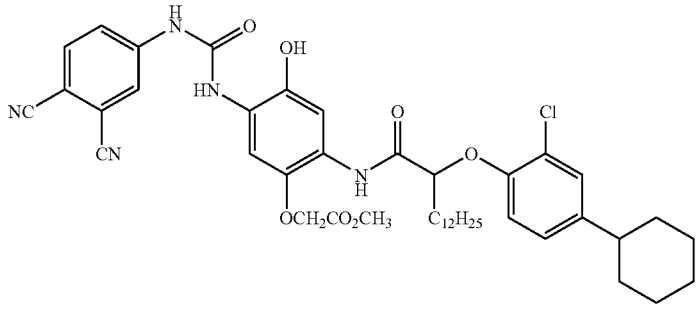

C-10:

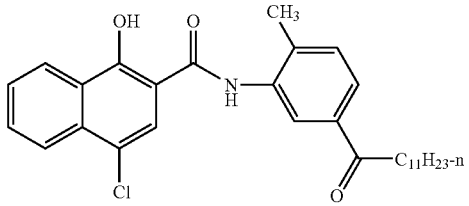

The DIRs used in the invention can be added to a mixture containing silver halide before coating or, more suitably, be mixed with the silver halide just prior to or during coating. In either case, additional components like couplers, doctors, surfactants, hardeners and other materials that are typically present in such solutions may also be present at the same time. The materials are not water-soluble and cannot be added directly to the solution. They may be added directly if dissolved in an organic water miscible solution such as methanol, acetone or the like or more preferably as a dispersion. A dispersion incorporates the material in a stable, finely divided state in a hydrophobic organic solvent (often referred to as a coupler solvent or permanent solvent) that is stabilized by suitable surfactants and surface active agents usually in combination with a binder or matrix such as gelatin. The dispersion may contain one or more permanent solvents that dissolve the material and maintain it in a liquid state. Some examples of suitable permanent solvents are tricresylphosphate, N,N-diethyllauramide, N,N-dibutyllauramide, p-dodecylphenol, dibutylphthalate, di-n-butyl sebacate, N-n-butylacetanilide, 9-octadecen-1-ol, ortho-methylphenyl benzoate, trioctylamine and 2-ethylhexylphosphate. Permanent solvents can also be described in terms of physical constants such as alpha, beta and pi* as defined by M. J. Kamlet, J-L. M. Abboud, M. H. Abraham and R. W. Taft, J. Org Chem, 48, 2877(1983). Preferred classes of solvents are carbonamides, phosphates, alcohols and esters. When a solvent is present, it is preferred that the weight ratio of compound to solvent be at least 1 to 0.5, or most preferably, at least 1 to 1. The dispersion may require an auxiliary coupler solvent initially to dissolve the component but this is removed afterwards, usually either by evaporation or by washing with additional water. Some examples of suitable auxiliary coupler solvents are ethyl acetate, cyclohexanone and 2-(2-butoxyethoxy)ethyl acetate. The dispersion may also be stabilized by addition of polymeric materials to form stable latexes. Examples of suitable polymers for this use generally contain water-solubilizing groups or have regions of high hydrophilicity. Some examples of suitable dispersing agents or surfactants are Alkanol XC or saponin. The materials used in the invention may also be dispersed as an admixture with another component of the system such as a coupler or an oxidized developer scavenger so that both are present in the same oil droplet. It is also possible to incorporate the materials of the invention as a solid particle dispersion; that is, a slurry or suspension of finely ground (through mechanical means) compound. These solid particle dispersions may be additionally stabilized with surfactants and/or polymeric materials as known in the art. Also, additional permanent solvent may be added to the solid particle dispersion to help increase activity.

Unless otherwise specifically stated, use of the term "substituted" or "substituent" means any group or atom other than hydrogen. Additionally, when the term "group" is used, it means that when a substituent group contains a substitutable hydrogen, it is also intended to encompass not only the substituent's unsubstituted form, but also its form further substituted with any substituent group or groups as herein mentioned, so long as the substituent does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy)butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl)carbonylamino, p-dodecylphenyl carbonyl amino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy) acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3- to 7-membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. When a molecule may have two or more substituents, the substituents may be joined together to form a ring such as a fused ring unless otherwise provided. Generally, the above groups and substituents thereof may include those having up to 48 carbon atoms, typically 1 to 36 carbon atoms and usually less than 24 carbon atoms, but greater numbers are possible depending on the particular substituents selected.

When the term "associated" is employed, it signifies that a reactive compound is in or adjacent to a specified layer where, during processing, it is capable of reacting with other components.

To control the migration of various components, it may be desirable to include a high molecular weight hydrophobe or "ballast" group in coupler molecules. Representative ballast groups include substituted or unsubstituted alkyl or aryl groups containing 8 to 42 carbon atoms. Representative substituents on such groups include alkyl, aryl, alkoxy, aryloxy, alkylthio, hydroxy, halogen, alkoxycarbonyl, aryloxycarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. In one embodiment of the invention the emulsion containing the dye layered grains containing the antenna dye described herein is in the magenta dye forming unit. Particularly useful is a silver halide photographic element wherein the silver halide photographic element further comprises a yellow filter dye in a layer between the support and the green sensitized layer closest to the support. A preferred dye is shown below.

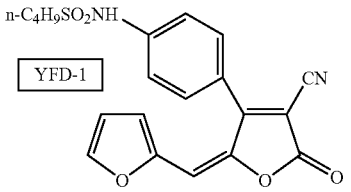

If desired, the photographic element can be used in conjunction with an applied magnetic layer as described in *Research Disclosure,* November 1992, Item 34390 published by Kenneth Mason Publications, Ltd., Dudley Annex, 12a North Street, Emsworth, Hampshire PO10 7DQ, ENGLAND, and as described in Hatsumi Kyoukai Koukai Gihou No. 94–6023, published Mar. 15, 1994, available from the Japanese Patent Office, the contents of which are incorporated herein by reference. When it is desired to employ the inventive materials in a small format film, *Research Disclosure,* June 1994, Item 36230, provides suitable embodiments. A particularly useful support for small format film is annealed polyethylenenaphthlate.

In the following discussion of suitable materials for use in the emulsions and elements of this invention, reference will be made to *Research Disclosure,* September 1996, Item 38957, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. More preferably the elements are negative working. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. Certain desirable photographic elements and processing steps are described in *Research Disclosure,* Item 37038, February 1995.

The following discussion relates to any additional coupling species present in the film element in conjunction with the couplers of the invention.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl such as oxazolidinyl or hydantoinyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in U.K. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: U.S. Pat. Nos. 2,367,531, 2,423,730, 2,474,293, 2,772,162, 2,895, 826, 3,002,836, 3,034,892, 3,041,236, 4,333,999, 4,883,746 and "Farbkuppler-eine LiteratureUbersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, 3,758,309, 4,540,654, and "Farbkuppler-eine LiteratureUbersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized and color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine LiteratureUbersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: U.K. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. Nos. 4,301,235; 4,853,319 and 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213,490; Japanese Published Application 58-172,647; U.S. Pat. Nos. 2,983,608; 4,070,191; and 4,273,861; German Applications DE 2,706,117 and DE 2,643,965; U.K. Patent 1,530,272; and Japanese Application 58-113935. The masking couplers may be shifted or blocked, if desired.

Typically, couplers are incorporated in a silver halide emulsion layer in a mole ratio to silver of 0.05 to 1.0 and generally 0.1 to 0.5. Usually the couplers are dispersed in a high-boiling organic solvent in a weight ratio of solvent to coupler of 0.1 to 10.0 and typically 0.1 to 2.0 although dispersions using no permanent coupler solvent are sometimes employed.

The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. Nos. 4,163,669; 4,865,956; and 4,923,784, may be useful. Also contemplated is use of the compositions in association with nucleating agents, development accelerators or their precursors (UK Patent 2,097,140; U.K. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g., as described in U.S. Pat. No. 4,366,237; EP 96,570; U.S. Pat. Nos. 4,420,556; and 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

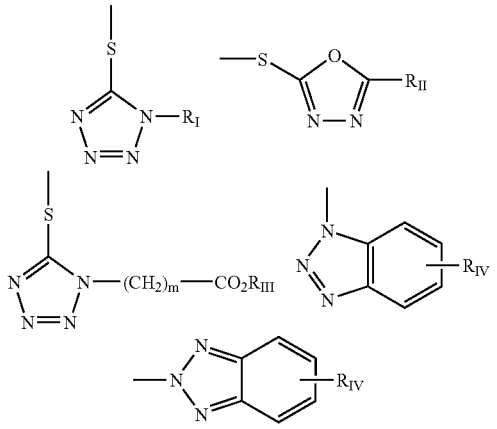

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S.Pat. No. 4,248,962); groups utilizing an electron transfer reaction along a conjugated system (U.S. Pat. Nos. 4,409,323; 4,421,845; 4,861,701, Japanese Applications 57-188035; 58-98728; 58-209736; 58-209738); groups that function as a coupler or reducing agent after the coupler reaction (U.S. Pat. Nos. 4,438,193; 4,618,571) and groups that combine the features describe above. It is typical that the timing group is of one of the formulas:

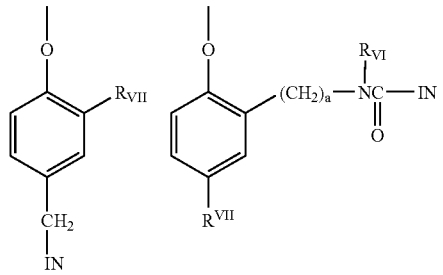

wherein IN is the inhibitor moiety, $R_{vII}$ is selected from the group consisting of nitro, cyano, alkylsulfonyl; sulfamoyl; and sulfonamido groups; a is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers for use in the present invention include, but are not limited to, the following:

D1

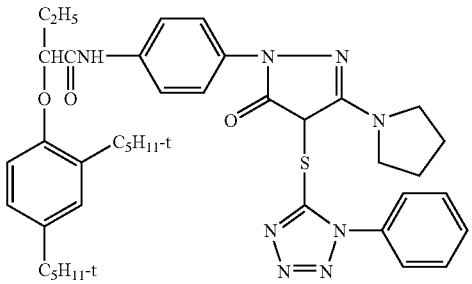

D2

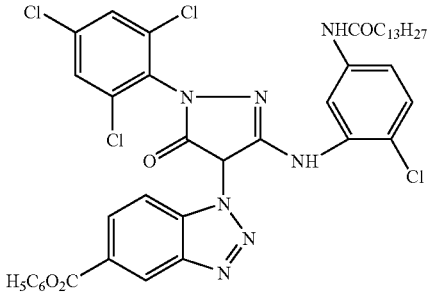

D3

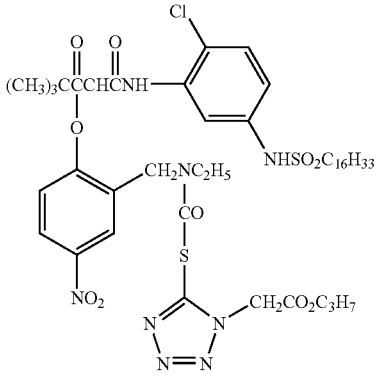

-continued
D4
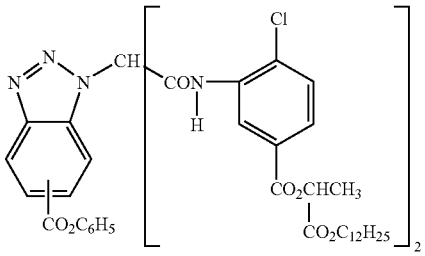
D5
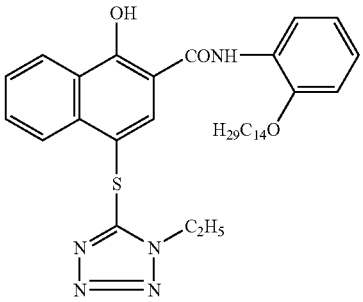
D6
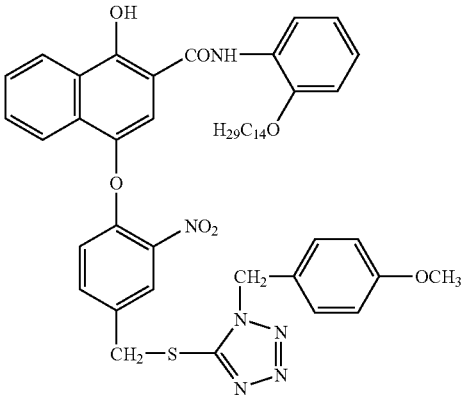
D7
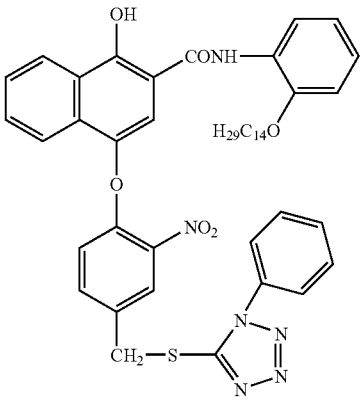
-continued
D8
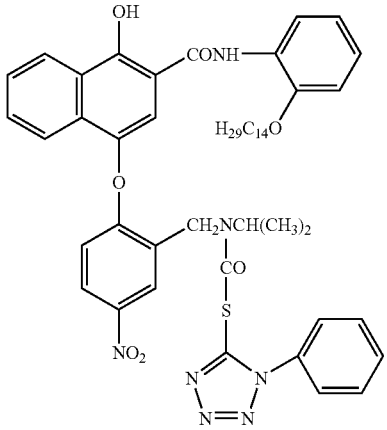
D9
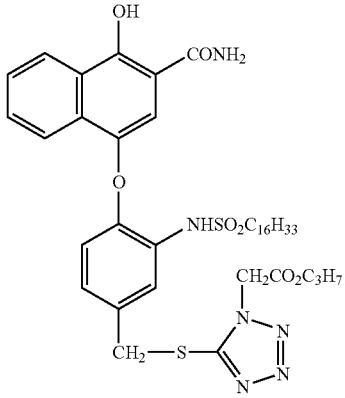
D10
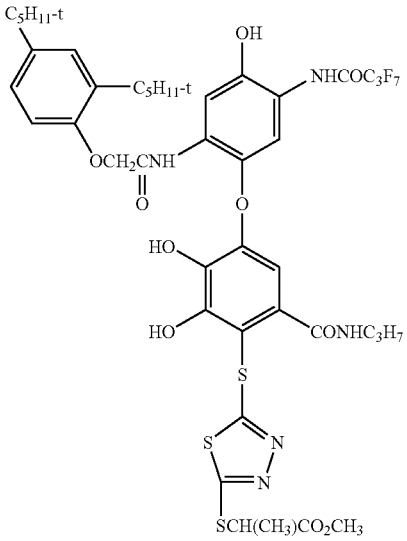

-continued

D11

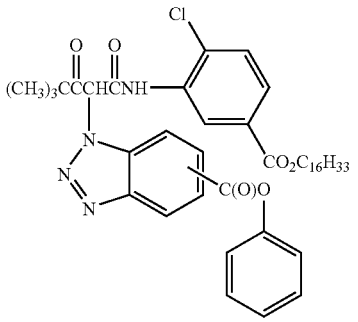

D12

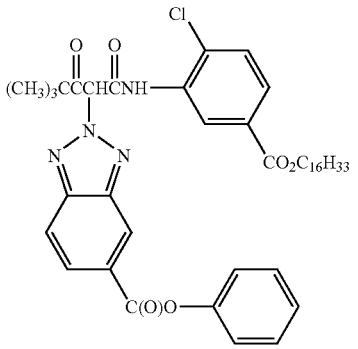

The silver halide used in the photographic elements may be silver iodobromide, silver bromide, silver chloride, silver chlorobromide, silver chloroiodobromide, and the like. The grain size of the silver halide may have any distribution known to be useful in photographic compositions, and may be either polydispersed or monodispersed.

The silver halide grains to be used in the invention may be prepared according to methods known in the art, such as those described in *Research Disclosure I* and *The Theory of the Photographic Process,* $4^{th}$ edition, T. H. James, editor, Macmillan Publishing Co., New York, 1977. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc., at suitable values during formation of the silver halide by precipitation.

Especially useful in this invention are radiation-sensitive tabular grain silver halide emulsions. Tabular grains are silver halide grains having parallel major faces and an aspect ratio of at least 2, where aspect ratio is the ratio of grain equivalent circular diameter (ECD) divided by grain thickness (t). The equivalent circular diameter of a grain is the diameter of a circle having an average equal to the projected area of the grain. A tabular grain emulsion is one in which tabular grains account for greater than 50 percent of total grain projected area. In preferred tabular grain emulsions tabular grains account for at least 70 percent of total grain projected area and optimally at least 90 percent of total grain projected area. It is possible to prepare tabular grain emulsions in which substantially all (>97%) of the grain projected area is accounted for by tabular grains. The non-tabular grains in a tabular grain emulsion can take any convenient conventional form. When coprecipitated with the tabular grains, the non-tabular grains typically exhibit a silver halide composition as the tabular grains.

The tabular grain emulsions can be either high bromide or high chloride emulsions. High bromide emulsions are those in which silver bromide accounts for greater than 50 mole percent of total halide, based on silver. High chloride emulsions are those in which silver chloride accounts for greater than 50 mole percent of total halide, based on silver. Silver bromide and silver chloride both form a face centered cubic crystal lattice structure. This silver halide crystal lattice structure can accommodate all proportions of bromide and chloride ranging from silver bromide with no chloride present to silver chloride with no bromide present. Thus, silver bromide, silver chloride, silver bromochloride and silver chlorobromide tabular grain emulsions are all specifically contemplated. In naming grains and emulsions containing two or more halides, the halides are named in order of ascending concentrations. Usually high chloride and high bromide grains that contain bromide or chloride, respectively, contain the lower level halide in a more or less uniform distribution. However, non-uniform distributions of chloride and bromide are known, as illustrated by Maskasky U.S. Pat. Nos. 5,508,160 and 5,512,427 and Delton U.S. Pat. Nos. 5,372,927 and 5,460,934, the disclosures of which are here incorporated by reference.

It is recognized that the tabular grains can accommodate iodide up to its solubility limit in the face centered cubic crystal lattice structure of the grains. The solubility limit of iodide in a silver bromide crystal lattice structure is approximately 40 mole percent, based on silver. The solubility limit of iodide in a silver chloride crystal lattice structure is approximately 11 mole percent, based on silver. The exact limits of iodide incorporation can be somewhat higher or lower, depending upon the specific technique employed for silver halide grain preparation. In practice, useful photographic performance advantages can be realized with iodide concentrations as low as 0.1 mole percent, based on silver. It is usually preferred to incorporate at least 0.5 (optimally at least 1.0) mole percent iodide, based on silver. Only low levels of iodide are required to realize significant emulsion speed increases. Higher levels of iodide are commonly incorporated to achieve other photographic effects, such as interimage effects. Overall iodide concentrations of up to 20 mole percent, based on silver, are well known, but it is generally preferred to limit iodide to 15 mole percent, more preferably 10 mole percent, or less, based on silver. Higher than needed iodide levels are generally avoided, since it is well recognized that iodide slows the rate of silver halide development.

Iodide can be uniformly or non-uniformly distributed within the tabular grains. Both uniform and non-uniform iodide concentrations are known to contribute to photographic speed. For maximum speed it is common practice to distribute iodide over a large portion of a tabular grain while increasing the local iodide concentration within a limited portion of the grain. It is also common practice to limit the concentration of iodide at the surface of the grains. Preferably the surface iodide concentration of the grains is less than 5 mole percent, based on silver. Surface iodide is the iodide that lies within 0.02 nm of the grain surface.

With iodide incorporation in the grains, the high chloride and high bromide tabular grain emulsions within the contemplated of the invention extend to silver iodobromide, silver iodochloride, silver iodochlorobromide and silver iodobromochloride tabular grain emulsions.

When tabular grain emulsions are spectrally sensitized, as herein contemplated, it is preferred to limit the average thickness of the tabular grains to less than 0.3 μm. Most preferably the average thickness of the tabular grains is less than 0.2 μm. In a specific preferred form the tabular grains are ultrathin—that is, their average thickness is less than 0.07 μm.

The useful average grain ECD of a tabular grain emulsion can range up to about 15 μm. Except for a very few high speed applications, the average grain ECD of a tabular grain emulsion is conventionally less than 10 μM, with the average grain ECD for most tabular grain emulsions being less than 5 μm.

The average aspect ratio of the tabular grain emulsions can vary widely, since it is quotient of ECD divided by grain thickness. Most tabular grain emulsions have average aspect ratios of greater than 5, with high (>8) average aspect ratio emulsions being generally preferred. Average aspect ratios ranging up to 50 are common, with average aspect ratios ranging up to 100 and even higher, being known.

The tabular grains can have parallel major faces that lie in either {100} or {111} crystal lattice planes. In other words, both {111} tabular grain emulsions and {100} tabular grain emulsions are within the specific contemplation of this invention. The {111} major faces of {111} tabular grains appear triangular or hexagonal in photomicrographs while the {100} major faces of {100} tabular grains appear square or rectangular.

High chloride {111} tabular grain emulsions are illustrated by Wey U.S. Pat. No. 4,399,215, Wey et al U.S. Pat. No. 4,414,306, Maskasky U.S. Pat. Nos. 4,400,463, 4,713,323, 5,061,617, 5,178,997, 5,183,732, 5,185,239, 5,399,478 and 5,411,852, Maskasky et al U.S. Pat. Nos. 5,176,992 and 5,178,998, Takada et al U.S. Pat. No. 4,783,398, Nishikawa et al U.S. Pat. No. 4,952,508, Ishiguro et al U.S. Pat. No. 4,983,508, Tufano et al U.S. Pat. No. 4,804,621, Maskasky and Chang U.S. Pat. No. 5,178,998, and Chang et al U.S. Pat. No. 5,252,452. Ultrathin high chloride {111} tabular grain emulsions are illustrated by Maskasky U.S. Pat. Nos. 5,271,858 and 5,389,509.

Since silver chloride grains are most stable in terms of crystal shape with {100} crystal faces, it is common practice to employ one or more grain growth modifiers during the formation of high chloride {111} tabular grain emulsions. Typically the grain growth modifier is displaced prior to or during subsequent spectral sensitization, as illustrated by Jones et al U.S. Pat. No. 5,176,991 and Maskasky U.S. Pat. Nos. 5,176,992, 5,221,602, 5,298,387 and 5,298,388, the disclosures of which are here incorporated by reference.

Preferred high chloride tabular grain emulsions are {100} tabular grain emulsions, as illustrated by the following patents, here incorporated by reference: Maskasky U.S. Pat. Nos. 5,264,337, 5,292,632, 5,275,930, 5,607,828 and 5,399,477, House et al U.S. Pat. No. 5,320,938, Brust et al U.S. Pat. No. 5,314,798, Szajewski et al U.S. Pat. No. 5,356,764, Chang et al U.S. Pat. Nos. 5,413,904, 5,663,041, and 5,744,297, Budz et al U.S. Pat. No. 5,451,490, Reed et al U.S. Pat. No. 5,695,922, Oyamada U.S. Pat. No. 5,593,821, Yamashita et al U.S. Pat. Nos. 5,641,620 and 5,652,088, Saitou et al U.S. Pat. No. 5,652,089, and Oyamada et al U.S. Pat. No. 5,665,530. Ultrathin high chloride {100} tabular grain emulsions can be prepared by nucleation in the presence of iodide, following the teaching of House et al and Chang et al, cited above. Since high chloride {100} tabular grains have {100} major faces and are, in most instances, entirely bounded by {100} grain faces, these grains exhibit a high degree of grain shape stability and do not require the presence of any grain growth modifier for the grains to remain in a tabular form following their precipitation.

In their most widely used form tabular grain emulsions are high bromide {111} tabular grain emulsions. Such emulsions are illustrated by Kofron et al U.S. Pat. No. 4,439,520, Wilgus et al U.S. Pat. No. 4,434,226, Solberg et al U.S. Pat. No. 4,433,048, Maskasky U.S. Pat. Nos. 4,435,501, 4,463,087 4,173,320 and 5,411,851 5,418,125, 5,492,801, 5,604,085, 5,620,840, 5,693,459, 5,733,718, Daubendiek et al U.S. Pat. Nos. 4,414,310 and 4,914,014, Sowinski et al U.S. Pat. No. 4,656,122, Piggin et al U.S. Pat. Nos. 5,061,616 and 5,061,609, Tsaur et al U.S. Pat. Nos. 5,147,771, '772, '773, 5,171,659 and 5,252,453, Black et al 5,219,720 and 5,334,495, Delton U.S. Pat. Nos. 5,310,644, 5,372,927 and 5,460,934, Wen U.S. Pat. No. 5,470,698, Fenton et al U.S. Pat. No. 5,476,760, Eshelman et al U.S. Pat. Nos. 5,612,175, 5,612,176 and 5,614,359, and Irving et al U.S. Pat. Nos. 5,695,923, 5,728,515 and 5,667,954, Bell et al U.S. Pat. No. 5,132,203, Brust U.S. Pat. Nos. 5,248,587 and 5,763,151,. Chaffee et al U.S. Pat. No. 5,358,840, Deaton et al U.S. Pat. No. 5,726,007, King et al U.S. Pat. No. 5,518,872, Levy et al U.S. Pat. No. 5,612,177, Mignot et al U.S. Pat. No. 5,484,697, Olm et al U.S. Pat. No. 5,576,172, Reed et al U.S. Pat. Nos. 5,604,086 and 5,698,387.

Ultrathin high bromide {111} tabular grain emulsions are illustrated by Daubendiek et al U.S. Pat. Nos. 4,672,027, 4,693,964, 5,494,789, 5,503,971 and 5,576,168, Antoniades et al U.S. Pat. No. 5,250,403, Olm et al U.S. Pat. No. 5,503,970, Deaton et al U.S. Pat. No. 5,582,965, and Maskasky U.S. Pat. No. 5,667,955. High bromide {100} tabular grain emulsions are illustrated by Mignot U.S. Pat. Nos. 4,386,156 and 5,386,156.

High bromide {100} tabular grain emulsions are known, as illustrated by Mignot U.S. Pat. No. 4,386,156 and Gourlaouen et al U.S. Pat. No. 5,726,006.

In many of the patents listed above (starting with Kofron et al, Wilgus et al and Solberg et al, cited above) speed increases without accompanying increases in granularity are realized by the rapid (a.k.a. dump) addition of iodide for a portion of grain growth. Chang et al U.S. Pat. No. 5,314,793 correlates rapid iodide addition with crystal lattice disruptions observable by stimulated X-ray emission profiles.

Localized peripheral incorporations of higher iodide concentrations can also be created by halide conversion. By controlling the conditions of halide conversion by iodide, differences in peripheral iodide concentrations at the grain corners and elsewhere along the edges can be realized. For example, Fenton et al U.S. Pat. No. 5,476,76 discloses lower iodide concentrations at the corners of the tabular grains than elsewhere along their edges. Jagannathan et al U.S. Pat. Nos. 5,723,278 and 5,736,312 disclose halide conversion by iodide in the corner regions of tabular grains.

Crystal lattice dislocations, although seldom specifically discussed, are a common occurrence in tabular grains. For example, examinations of the earliest reported high aspect ratio tabular grain emulsions (e.g., those of Kofron et al, Wilgus et al and Solberg et al, cited above) reveal high levels of crystal lattice dislocations. Black et al U.S. Pat. No. 5,709,988 correlates the presence of peripheral crystal lattice dislocations in tabular grains with improved speed-granularity relationships. Ikeda et al U.S. Pat. No. 4,806,461 advocates employing tabular grain emulsions in which at least 50 percent of the tabular grains contain 10 or more dislocations. For improving speed-granularity characteristics, it is preferred that at least 70 percent and optimally at least 90 percent of the tabular grains contain 10 or more peripheral crystal lattice dislocations.

The silver halide emulsion may comprise tabular silver halide grains having surface chemical sensitization sites including at least one silver salt forming epitaxial junction with the tabular grains and being restricted to those portions of the tabular grains located nearest peripheral edges.

The silver halide tabular grains of the photographic material may be prepared with a maximum surface iodide concentration along the edges and a lower surface iodide concentration within the corners than elsewhere along the edges.

In the course of grain precipitation one or more dopants (grain occlusions other than silver and halide) can be introduced to modify grain properties. For example, any of the various conventional dopants disclosed in *Research Disclosure,* Item 38957, Section I. Emulsion grains and their preparation, sub-section G. Grain modifying conditions and adjustments, paragraphs (3), (4) and (5), can be present in the emulsions of the invention. Especially useful dopants are disclosed by Marchetti et al., U.S. Pat. No. 4,937,180, and Johnson et al., U.S. Pat. No. 5,164,292. In addition it is specifically contemplated to dope the grains with transition metal hexacoordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in Research Disclosure Item 36736 published November 1994, here incorporated by reference.

SET dopants are known to be effective to reduce reciprocity failure. In particular the use of $Ir^{+3}$ or $Ir^{+4}$ hexacoordination complexes as SET dopants is advantageous.

Iridium dopants that are ineffective to provide shallow electron traps (non-SET dopants) can also be incorporated into the grains of the silver halide grain emulsions to reduce reciprocity failure.

The contrast of the photographic element can be further increased by doping the grains with a hexacoordination complex containing a nitrosyl or thionitrosyl ligand (NZ dopants) as disclosed in McDugle et al U.S. Pat. No. 4,933,272, the disclosure of which is here incorporated by reference.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by Evans et al. U.S. Pat. No. 4,504,570.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. One type of such element, referred to as a color negative film, is designed for image capture. Preferably the materials of the invention are color negative films. Speed (the sensitivity of the element to low light conditions) is usually critical to obtaining sufficient image in such elements. Such elements are typically silver bromoiodide emulsions coated on a transparent support and are sold packaged with instructions to process in known color negative processes such as the Kodak C-41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3' 15" or less and desirably 90 or even 60 seconds or less.

The photographic element of the invention can be incorporated into exposure structures intended for repeated use or exposure structures intended for limited use, variously referred to by names such as "one time use camera", "single use cameras", "lens with film", or "photosensitive material package units".

Another type of color negative element is a color print. Such an element is designed to receive an image optically printed from an image capture color negative element. A color print element may be provided on a reflective support for reflective viewing (e.g., a snapshot) or on a transparent support for projection viewing as in a motion picture. Elements destined for color reflection prints are provided on a reflective support, typically paper, employ silver chloride emulsions, and may be optically printed using the so-called negative-positive process where the element is exposed to light through a color negative film which has been processed as described above. The element is sold packaged with instructions to process using a color negative optical printing process, for example, the Kodak RA-4 process, as generally described in PCT WO 87/04534 or U.S. Pat. No. 4,975,357, to form a positive image. Color projection prints may be processed, for example, in accordance with the Kodak ECP-2 process as described in the H-24 Manual. Color print development times are typically 90 seconds or less and desirably 45 or even 30 seconds or less.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The entire contents of the patents and other publications cited in this specification are incorporated herein by reference. The following examples are intended to illustrate, but not to limit the invention:

Synthesis of DIR-3 and DIR-8:

Preparation of E: 2-Hexyldecanoic acid (26.9 g, 0.1 mole) was dissolved in $CH_2Cl_2$ (250 mL), then cooled to 0° C. A drop of dimethylformamide was added to the solution followed by oxalyl chloride (16.8 g, 0.13 mole, 11.5 mL) dropwise. The reaction was warmed to room temperature and stirred for 3 hours. The generated acid halide was evaporated to dryness. Into a separate flask was placed 9.67 g (50.0 mmol) 5-amino-1-hydroxy-2-naphthoic acid (prepared as described in K. N. Kilminster and C. Holstead, Research Disclosure, 180, 195–7 (1979) and Y. Maekawa, Jpn. Kokai Tokyo Koho, 3 (2000), dimethylaniline (1 3.38 g, 110.4 mmol, 14.0 mL), and dimethylacetamide (200 mL). After the temperature had cooled to 0° C., the generated acid halide was added dropwise in 50 mL dimethylacetamide. Once addition was complete, the reaction was warmed to room temperature then stirred for 16 h. The reaction mixture was then added dropwise to a highly stirred solution of concentrated HCl (36.5%, 100 mL), ice (1000 mL), and distilled water (1000 mL). A solid formed and was removed by filtration. The product E (44.0 g, 0.099 mol, 99% yield) was isolated as a grayish solid after washing the solid well with distilled water and acetonitrile followed by drying under vacuum. Obtained analytical information was consistent with structure.

Preparation of F: Carboxylic acid E (10.0 g, 22.6 mmol) and o-anisidine (3.06 g, 25.0 mmol, 2.8 mL) were dissolved in anhydrous THF (150 mL). To this solution was added a solution of dicyclohexylcarbodiimide (5.12 g, 24.8 mmol) in anhydrous THF (40 mL). After the addition was complete, the reaction was warmed to 60° C. for 8h then at room temperature for 16 h. The urea was removed by filtration and the filtrate evaporated to dryness. The residue was dissolved in EtOAc (250 mL), then washed with 10% HCl and saturated brine. The EtOAc solution was dried over anhydrous $MgSO_4$, filtered, and evaporated to dryness. The resulting solid was triturated with MeOH. A tan solid was collected. The product F (9.33 g, 17.1 mmol, 75% yield) was isolated after recrystallization from propyl acetate/acetonitrile (3/1). Obtained analytical information was consistent with structure.

Preparation of DIR-3: 2,5-Dihydro-5-thioxo-1H-tetrazole-1-acetic acid, propyl ester cyclohexylamine salt (2.2 g, 7.3 mmol) was dissolved in dimethylformamide (30 mL). Sulfuryl chloride (1.00 g, 7.5 mmol, 0.6 mL) was added all at once. The reaction was warmed to 35° C. and stirred for 30 minutes. To this solution was added intermediate F (2.5 g, 4.6 mmol) all at once. The reaction was warmed to 75° C. for 2 h, then stirred at room temperature for 12 h. At that time, the reaction was poured into 50 mL 10% HCl, then extracted with EtOAc (3×50 mL). The combined extracts were washed with saturated $NaHCO_3$ (3×25 mL), 10% HCl (25 mL), and saturated brine (25 mL). Extracts were dried over anhydrous $Na_2SO_4$, filtered, and evaporated to dryness. The product (white solid, 2.94 g, 3.9 mmol, 85% yield) was isolated by trituration from $Et_2O$.

Synthesis of DIR-8:

Preparation of B: 20 g (84.9 mmol) of N-(6-Chloro-5-hydroxy-1-naphthalenyl)acetamide (prepared as described in A. Friedman and T. Kissel, EP603953A1 (1994)) was mixed with THF (50 mL). To that solution was added an aqueous solution of NaOH (6.0M, 0.4 moles, 70 mL). The mixture was refluxed for 3 h. After cooling, the solution was acidified to pH 1.0 using 2.0 M HCl. Upon cooling, the product (17.6 g, 76.4 mmol, 90% yield) precipitated. The solid was collected by filtration, filtered, washed with distilled water, then heptane, and dried under vacuum. Obtained analytical data was consistent with structure.

Preparation of C: 2-Hexyldecanoic acid (13.45 g, 52.5 mmol) was dissolved in $CH_2Cl_2$ (125 mL) and cooled to 0° C. A drop of dimethylformamide was added to the solution followed by oxalyl chloride (8.43 g, 66.5 mmol, 5.8 mL) dropwise. The reaction was warmed to room temperature and stirred for 3 hrs. The generated acid halide was evaporated to dryness. Into a separate flask was placed B (9.67 g, 50.0 mmol), dimethylaniline (13.38 g, 110.4 mmol, 14.0 mL), and THF (125 mL). After the temperature had cooled to 0° C., the generated acid halide was added dropwise in 50 mL $CH_2Cl_2$. Once addition was complete, the reaction was warmed to room temperature then stirred for 16 hr. The reaction mixture was poured into 250 mL 10% HCl, then extracted with EtOAc (3×250 mL). The extracts were combined, washed with brine (50 mL), dried over anhydrous $Na_2SO_4$, filtered, and evaporated to dryness. Trituration of the reddish solid with $CH_2Cl_2$ produced the product as a white solid. The product was isolated by filtration, then dried under vacuum resulting in white solid (13.95 g, 32.3 mmol, 64% yield). Obtained analytical data was consistent with structure.

Preparation of DIR-8: 1,2-Dihydro-1-phenyl-5H-tetrazole-5-thione, sodium salt (1.74 g, 8.7 mmol) was dissolved in dimethylformamide (50 mL). Sulfuryl chloride (1.24 g, 9.2 mmol, 0.74 mL) was added all at once. The reaction was warmed to 35° C. and stirred for 30 mins. To this solution was added C (2.5 g, 5.8 mmol) all at once. The reaction was warmed to 75° C. for 2 hr, then stirred at room temperature for 12 hr. At that time, the reaction was poured into 50 mL 10% HCl, then extracted with EtOAc (3×50 mL). The combined extracts were washed with saturated $NaHCO_3$ (2×25 mL), 10% HCl (25 mL), and saturated brine (25 mL). Extracts were dried over anhydrous $Na_2SO_4$, filtered, and evaporated to dryness. The product (white solid, 1.61 g, 2.6 mmol, 46% yield) was isolated by column chromatography on flash SiO2 eluting with a gradient from 10% to 40% EtOAc/heptane. Obtained analytical information was consistent with structure.

Photographic Examples

Single layer films demonstrating the principles of this invention were produced by coating the following layers on a cellulose triacetate film support with a RemJet antihalation backing (coverage are in grams per meter squared, emulsion sizes as determined by the disc centrifuge method and are reported in diameter×thickness in micrometers). Surfactants, coating aids and emulsion addenda (including 4-hydroxy-6-methyl-1,3,3a,7-tetraazaindene) were added to the appropriate layers as is common in the art.

Sample SL-1 (No Inhibitor Check):

Imaging Layer: gelatin at 1.508; an iodobromide tabular emulsion: 3.9×0.129, 3.7% I (red-sensitized with a mixture of RSD-1, RSD-3 and RSD-4) at 0.800; cyan image coupler C-1 at 0.200 and cyan bleach accelerator releasing coupler B-1 at 0.024. When present, the inhibitor releasing compounds (dispersed in twice their own weight in tricresylphosphate) were added at 0.01 mmol/$m^2$.

Overcoat: gelatin at 2.691 and bis(vinylsulfonyl)methane hardener at 1.8% of total gelatin weight added just prior to coating.

These single layer coatings were given a stepped neutral exposure and processed in the KODAK FLEXICOLOR™ (C-41) process as described in *British Journal of Photography Annual,* 1988, pp 196–198. Relative speed or light sensitivity was determined by comparing the ratio of the exposure points +0.15 red density units above red Dmin of the experimental coating with the DIR to the check position without any DIR. A ratio greater than 1.0 indicates increased speed; a ratio less than one means a loss in speed. Contrast was determined by the maximum slope between any two points on the density-log exposure plot. Results are listed in Table 1.

TABLE 1

Inhibitor Releasing Compounds in Single Layer Format

| Sample | Comparative or Invention | DIR | Dmin | Relative Speed | Contrast |
|---|---|---|---|---|---|
| SL-1 | Comp | None | 0.093 | 1.000 | 1.05 |
| SL-2 | Comp | CD-1 | 0.121 | 0.989 | 1.01 |
| SL-3 | Comp | CD-2 | 0.081 | 0.986 | 0.91 |
| SL-4 | Comp | CD-3 | 0.078 | 0.984 | 0.94 |
| SL-5 | Comp | CD-4 | 0.080 | 0.985 | 0.91 |
| SL-6 | Comp | CD-5 | 0.090 | 0.998 | 1.08 |
| SL-7 | Comp | CD-6 | 0.092 | 0.997 | 1.08 |
| SL-8 | Inv | DIR-3 | 0.095 | 0.995 | 0.93 |
| SL-9 | Inv | DIR-6 | 0.089 | 0.997 | 0.95 |
| SL-10 | Inv | DIR-8 | 0.076 | 0.989 | 0.93 |

As seen in Table 1, the inhibitor releasing compounds of the invention gave lower contrast, indicating increased activity, while providing a smaller decrease in photographic speed relative to known materials. For example, CD-5 and CD-6, which do not release an inhibitor group, fail to decrease contrast at all. DIR-3 and DIR-6 gives superior results relative to CD-1 that releases the same inhibitor fragment. DIR-8 gives superior results to CD-2 or CD-4 that also releases the same inhibitor fragment.

Additional single layer films demonstrating the principles of the invention were produced by coating the following layers on a cellulose triacetate film support with a tin oxide antistatic-backing. Surfactants and coating aids were added to the appropriate layers as common in the art.

Samples SL-1 1 and SL-12:

Imaging Layer: gelatin at 3.77, an undyed silver iodobromide emulsion at 0.646; a codispersion consisting of coupler C-1 at 0.387, coupler C-2 at 0.129, dibutyl sebacate at 0.644, 2,4-bis(1,1-dimethylpropyl)-phenol at 0.129 and N-butyl acetanilide at 0.032 and 0.054 (SL-11) or 0.108 (SL-12) umol/$m^2$ of CD-1 dispersed in tricresylphosphate.

Overcoat: gelatin at 2.69 and bis(vinylsulfonyl)methane hardener at 1.8% of total gelatin weight added just prior to coating.

Samples SL-13 and SL-14: Like SL-11/12 but an equimolar amount of DIR-6 replaces CD-1

Samples SL-15 and SL-16: Like SL-1/12 except that the CD-1 was dispersed in N-butyl acetanilide Samples SL-17 and SL-18: Like SL-15/16 except an equimolar amount of DIR-12 (dispersed in N-butyl acetanilide) replaces CD-1

Samples SL-19 and SL-20: Like SL-15/16 except 0.052 and 0.108 umoles/$m^2$ of DIR-13 (dispersed in N-butyl acetanilide) replaces CD-1

Samples SL-21 and SL-22: Like SL-11/12 but an equimolar amount of CD-2 replaces CD-1

Samples SL-23 and SL-24: Like SL-21/22 but an equimolar amount of DIR-8 replaces CD-2

These single layer coatings were given a stepped neutral exposure and processed in a variation (see processing table below) of the KODAK FLEXICOLOR™ (C-41) process as described in *British Journal of Photography Annual,* 1988, pp 196–198. Results are shown in Table 2.

| Processing Step | Time (s) | Time (min) | Agitation gas |
|---|---|---|---|
| C-41 Developer | 120 | 2 | Nitrogen |
| pH 1.0 Sulfuric Acid Stop bath | 30 | ½ | Nitrogen |
| 1st Wash (running water) | 120 | 2 | None |
| Flexicolor Bleach III | 180 | 3 | Air |
| 2nd Wash (running water) | 180 | 3 | None |
| C-41 Fixer Replenisher | 240 | 4 | Nitrogen |
| 3rd Wash (running water) | 180 | 3 | None |
| Photo-Flo (wetting agent) | 30 | ½ | None |

Processing temperature 100° F. (37.8 C)

TABLE 2

Inhibitor Releasing Compounds in Single Layer Format

| Sample | Comparative or Invention | DIR | Contrast |
|---|---|---|---|
| | N-Alkylmercaptotetrazole Inhibitors | | |
| SL-11 | Comparative | CD-1 | 0.89 |
| SL-12 | " | " | 0.61 |
| SL-13 | Inventive | DIR-6 | 0.72 |
| SL-14 | " | " | 0.43 |
| SL-15 | Comparative | CD-1 | 0.98 |
| SL-16 | " | " | 0.70 |
| SL-17 | Inventive | DIR-12 | 1.01 |
| SL-18 | " | " | 1.78 |
| SL-19 | Inventive | DIR-13 | 0.91 |
| SL-20 | " | " | 0.69 |
| | N-Phenylmecaptotetrazole Inhibitors | | |
| SL-21 | Comparative | CD-2 | 0.48 |
| SL-22 | " | " | 0.25 |
| SL-23 | Inventive | DIR-8 | 0.29 |
| SL-24 | " | " | 0.18 |

The results in Table 2 clearly show that the DIRs of the invention have increased activity relative to analogous prior art DIRs.

Multilayer films demonstrating the principles of this invention were produced by coating the following layers on a cellulose triacetate film support (coverage are in grams per meter squared, emulsion sizes as determined by the disc centrifuge method and are reported in diameter x thickness in micrometers). Surfactants, coating aids, emulsion addenda (including 4-hydroxy-6-methyl-1,3,3a,7-tetraazaindene), sequestrants, thickeners, lubricants, matte and tinting dyes were added to the appropriate layers as is common in the art. All comparative and inventive image modifiers were dispersed in twice their own weight in tricresylphosphate.

Sample ML-1:

Layer 1 (Antihalation layer): gelatin at 1.08, colloidal gray silver at 0.150; ILS-1 at 0.097; DYE-1 at 0.008; DYE-2 at 0.061; DYE-3 at 0.025; H-1 at 0.0161 and UV-1 at 0.075.

Layer 2 (Slow cyan layer): a blend of two red-sensitized (both with a mixture of RSD-1, RSD-2 and RSD-3) tabular silver iodobromide emulsions: (i) a 0.7×0.108, 4.5% I at 0.211, (ii) a 0.435×0.112, 0.5% I at 0.334; a codispersion of cyan dye-forming couplers C-1 at 0.332 and C-2 at 0.111; bleach accelerator releasing coupler B-1 at 0.075; image modifier D-1 at 0.013; image modifier D-2 at 0.021; masking coupler MC-1 at 0.012 and gelatin at 1.811.

Layer 3 (Mid cyan layer): a 1.275×0.122, 3.7% I red-sensitized (with a mixture of RSD-1, RSD-2 and RSD-3)

iodobromide tabular emulsion at 0.555; a codispersion of C-1 at 0.167 and C-2 at 0.056; D-1 at 0.032; D-2 at 0.017; masking coupler MC-1 at 0.072; yellow dye forming coupler Y-1 at 0.070 and gelatin at 1.15.

Layer 4 (Fast cyan layer): a blend of two iodobromide tabular emulsions: (i) a 3.9×0.129, 3.7% I (red-sensitized with a mixture of RSD-1, RSD-3 and RSD-4) at 0.250 and (ii) a 2.3×0.13, 3.7% I (red-sensitized with a mixture of RSD-1, RSD-2 and RSD-3) at 0.525; a codispersion of C-1 at 0.037 and C-2 at 0.012; D-1 at 0.045; D-2 at 0.050; B-1 at 0.032; MC-1 at 0.030 and gelatin at 0.977.

Layer 5 (Interlayer): D-1 at 0.0161; speed addenda H-1 at 0.025 and gelatin at 0.539.

Layer 6 (Slow magenta layer): a 0.47×0.118, 3% I green-sensitized (with a mixture of GSD-1 and GSD-2) silver iodobromide tabular emulsion at 0.300; magenta dye-forming coupler M-1 at 0.182; MC-2 at 0.102 and gelatin at 1.184.

Layer 7 (Mid magenta layer): a blend of three green-sensitized (all with a mixture of GSD-1 and GSD-2) silver iodobromide tabular emulsions: (i) a 1.18×0.121, 4.5% I at 0.485 (ii) a 0.47×0.118, 3% I at 0.120 (iii) a 2.3×0.132, 4.5% I at 0.033; M-1 at 0.296; MC-2 at 0.073; D-3 at 0.029; D-4 at 0.007 and gelatin at 1.705.

Layer 8 (Fast magenta layer): a blend of two green-sensitized (both with a mixture of GSD-1 and GSD-2) silver iodobromide tabular emulsions: a 2.9×0.132, 3.7% I at 0.440 and a 2.3×0.132, 4.5% 1 at 0.560; M-1 at 0.085; MC-2 at 0.082; D-3 at 0.013; D-4 at 0.016; B-1 at 0.0025 and gelatin at 1.276.

Layer 9 (Interlayer): H-1 at 0.025; D-5 at 0.016 and gelatin at 0.538.

Layer 10 (Slow yellow layer): a blend of three blue-sensitized (all with BSD-1 and BSD-2) tabular silver iodobromide emulsions (i) a 1.26×0.137, 4.1% I at 0.160 (ii) a 0.99×0.144, 1.4% I at 0.325 (iii) a 0.53×0.083, 1.3% I at 0.230; Y-1 at 1.060; D-6 at 0.054; D-1 at 0.032; B-1 at 0.005; stabilizer S-1 at 0.024; gelatin at 1.803 and bis(vinylsulfonyl)methane hardener at 1.8% of total gelatin weight added just prior to coating.

Layer 11 (Fast yellow layer): a blend of two blue-sensitized (with BSD-1 and BSD-2) tabular silver iodobromide emulsions: (i) a 2.67×0.13 4.1% I at 0.650 (ii) a 0.53×0.083 1.3% I at 0.230 and a blue sensitized (with BSD-1) 3-D (5 micron diameter), 9.7% I silver iodobromide emulsion at 0.260; silver bromide Lippman emulsion at 0.054; Y-1 at 0.255; Y-2 at 0.108; DIR-6 at 0.092; B-1 at 0.005 and gelatin at 0.950.

Layer 12 (UV Filter Layer): silver bromide Lippman emulsion at 0.161; UV-1 and UV-2 both at 0.105 and gelatin at 0.690.

Layer 13 (Protective overcoat): gelatin at 0.867.

Sample ML-2: Like ML-1 except D-2 in Layer 4 was replaced with CD-1 at 0.056

Sample ML-3: Like ML-1 except D-2 in Layer 4 was replaced with DIR-6 at 0.0523.

Sample ML-4: Like ML-1 except D-1 in Layer 4 was removed.

Sample ML-5: Like ML-4 except added 0.056 CD-1 to Layer 4.

Sample ML-6: Like ML-4 except added 0.0523 DIR-6 to Layer 4.

Sample ML-7: Like ML-4 except added 0.027 CD-2 to Layer 4.

Sample ML-8: Like ML-4 except added 0.025 DIR-8 to Layer 4.

Formulas for materials used in the above formats are as follows:

ILS-1:

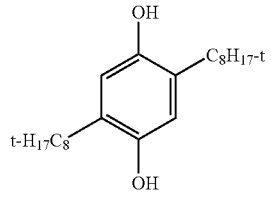

DYE-1:

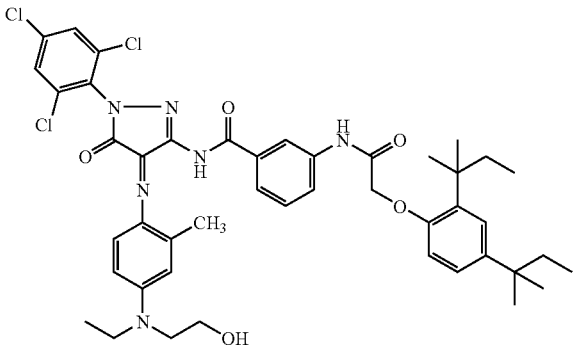

DYE-2:

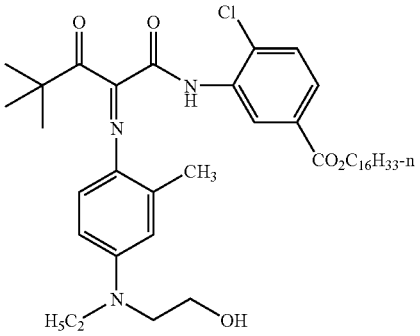

DYE-3:

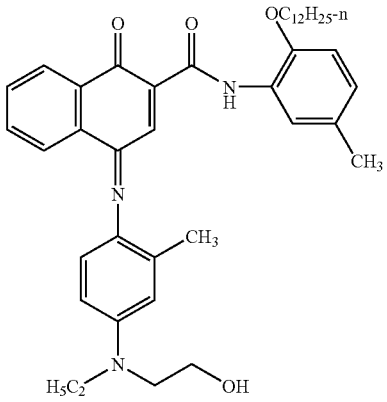

H-1:

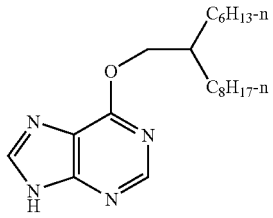

-continued
C-1:
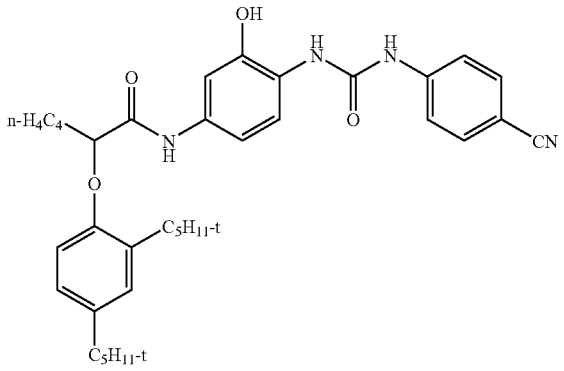
C-2:
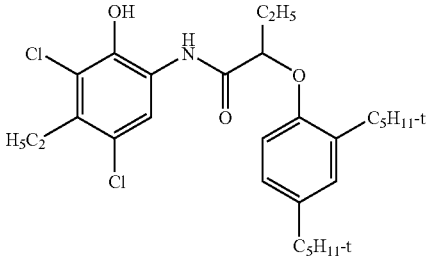
B-1:
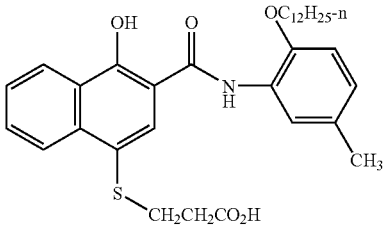
D-1:
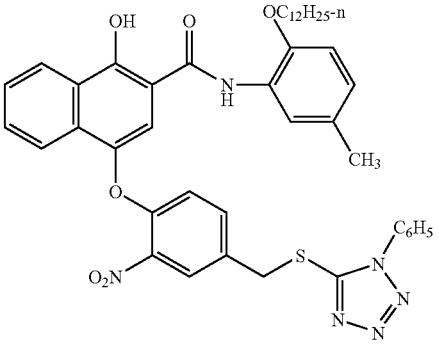
D-2:
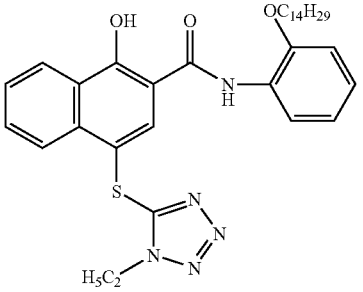
-continued
D-3:
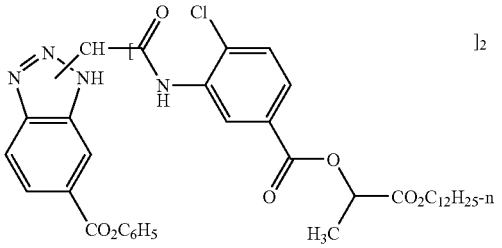
D-4:
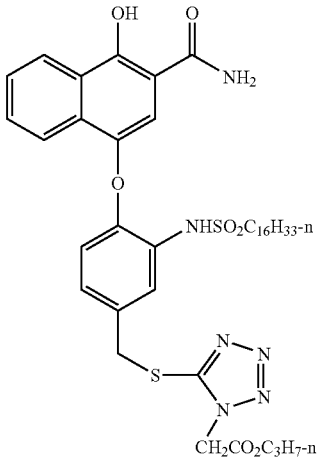
D-5:
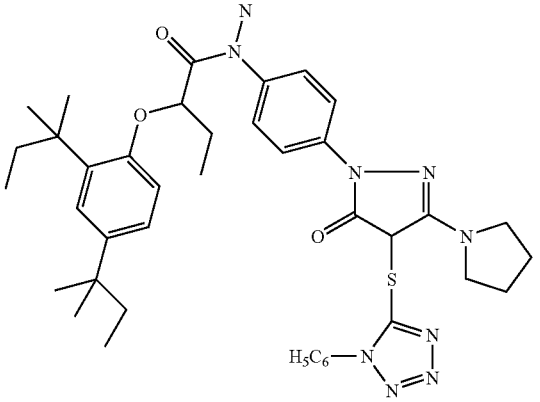
D-6:
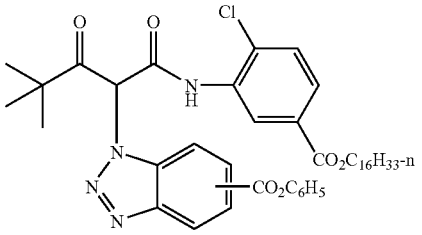

-continued
MC-1:
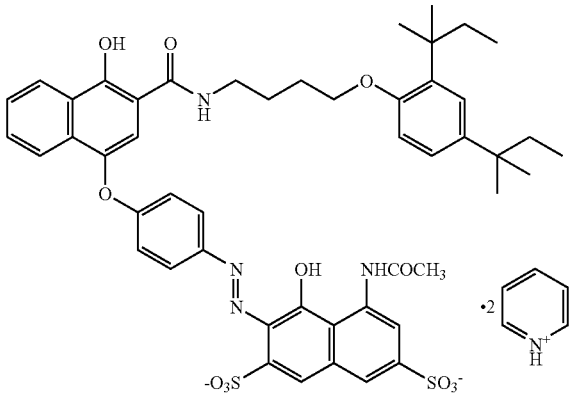
MC-2
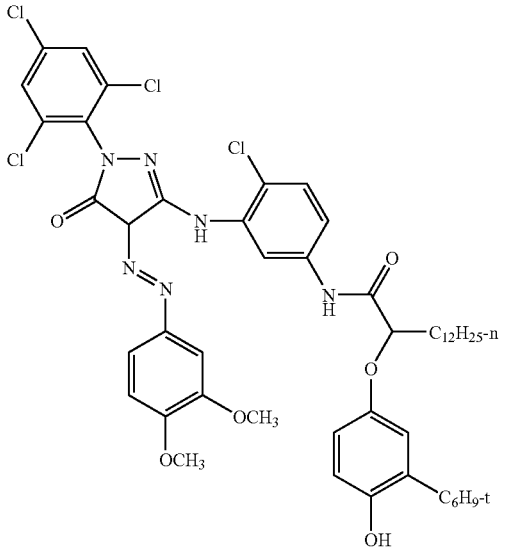
M-1:
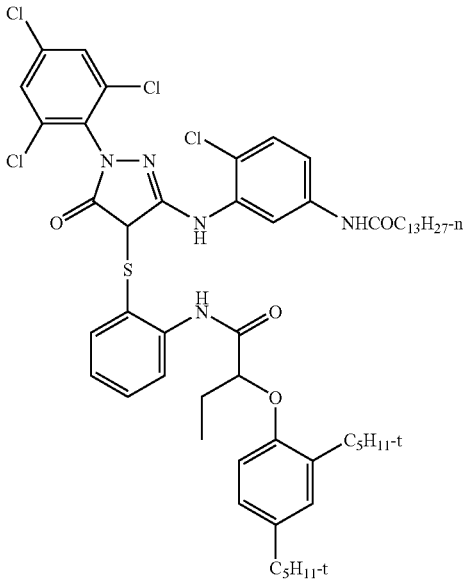
-continued
Y-1:
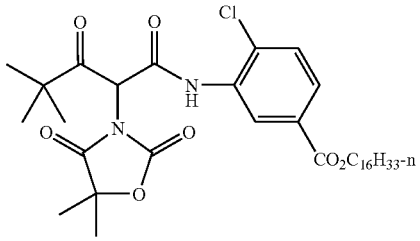
Y-2:
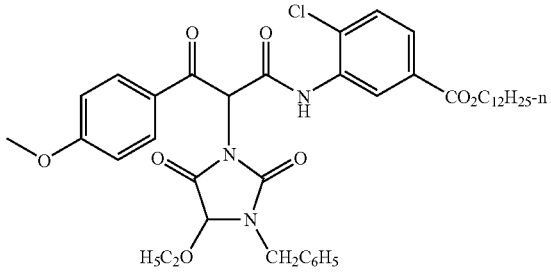
S-1:
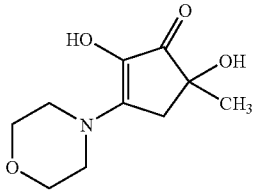
UV-1:
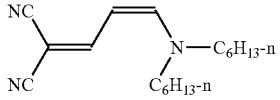
UV-2:
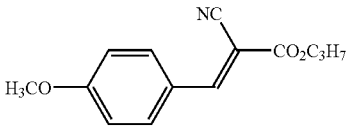
BSD-1:
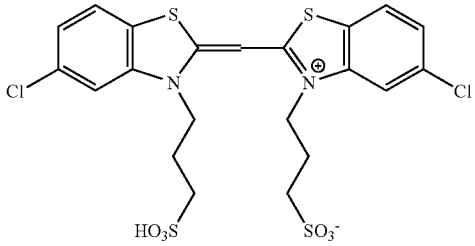
BSD-2:
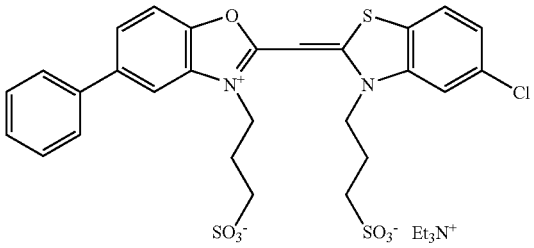

-continued
GSD-1:
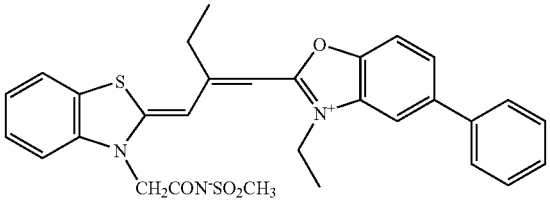
GSD-2:
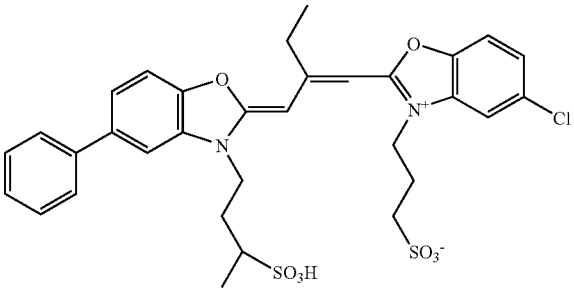
RSD-1:
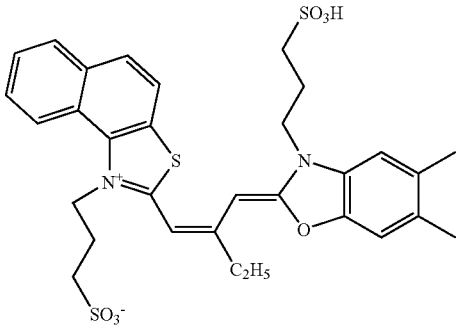
RSD-2:
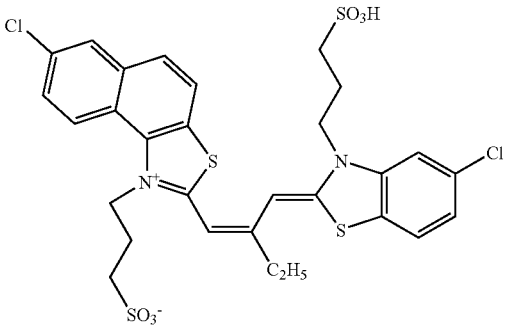
RSD-3:
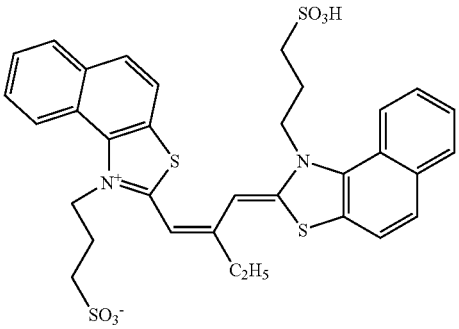
-continued
RSD-4:
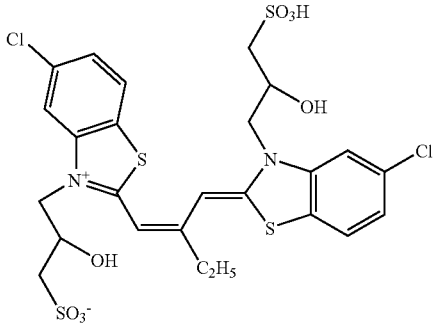
CD-1:
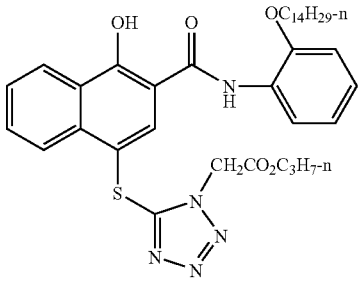
CD-2:
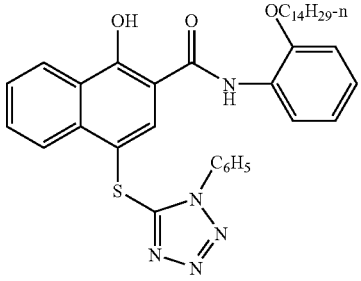
CD-3:
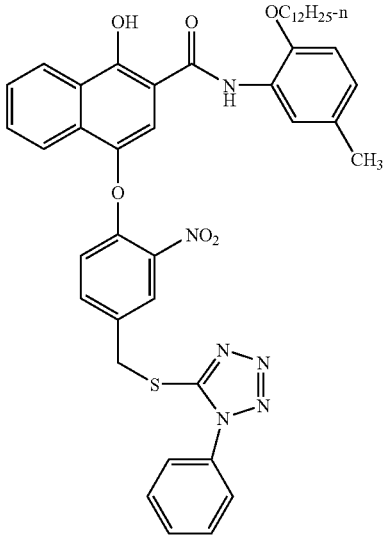

-continued

CD-4:

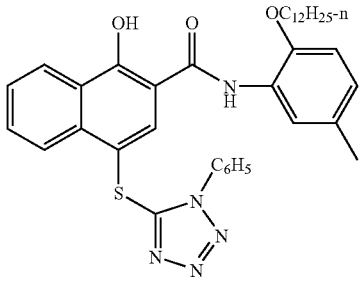

CD-5:

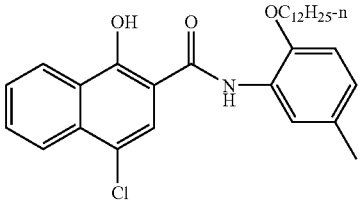

CD-6:

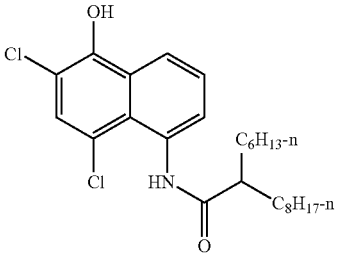

To determine red-onto-green (RG) interimage, these multilayer coatings were given a stepped exposure in the red record exposure (and processed in the KODAK FLEXICOLOR™ (C-41) process as described in *British Journal of Photography Annual,* 1988, pp 196–198) while the green and blue color layers were simultaneously given an uniform, non-imagewise flash exposure so that the green density ($G_{minR}$) was close to 0.80 when there was no red record development (minimum red exposure point). Then, a red exposure point was determined that was 0.6 logE units more than the point that was 0.15 red density units above red Dmin. The green density ($G_R$) was read at this red exposure point. RG interimage is the difference in green density $G_R$-$G_{minR}$ and represents the decrease in green layer development as a function of red development. In this case, a negative number reflects a greater loss in density and hence, an increase in red-onto-green interimage. Results are shown in Table 3.

TABLE 3

Inhibitor Releasing Compounds in Multilayer Format

| Sample | Comparative or Invention | DIR in Layer 4 | RG Interimage |
|---|---|---|---|
| ML-1 | Comp | D-1 + D-2 | −0.041 |
| ML-2 | Comp | D-1 + CD-1 | −0.064 |
| ML-3 | Inv | D-1 + DIR-6 | −0.077 |
| ML-4 | Comp | D-2 | −0.029 |
| ML-5 | Comp | D-2 + CD-1 | −0.036 |
| ML-6 | Inv | D-2 + DIR-6 | −0.059 |
| ML-7 | Comp | D-2 + CD-2 | −0.056 |
| ML-8 | Inv | D-2 + DIR-8 | −0.077 |

The data in Table 3 clearly show that the inventive compounds give improved red-onto-green interimage relative to an equimolar amount of comparative compounds that release the same inhibitor fragment. For example, in ML-5, CD-1 only gives a RG value of −0.036 whereas in ML-6, DIR-6 has a RG value of −0.059. The same improvement can also be seen with DIR-8 over CD-2 in samples ML-7 and ML-8.

The invention has been described in detail with particular reference to certain preferred embodiments thereof, but it will be understood that variations and modifications can be effected within the spirit and scope of the invention.

The invention claimed is:

1. A silver halide photographic element comprising a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler, wherein at least one of the silver halide emulsion layers additionally contains a 2-substituted-5-amino-1-napthol DIR according to Formula (I):

Formula (I)

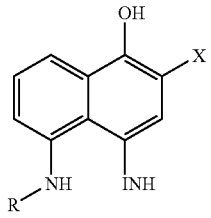

wherein:

X is chosen from among hydrogen, halogen atoms, an alkyl group with 6 carbon atoms or less or an N-substituted carbamoyl group wherein the N substituent is either an alkyl group with 6 carbon atoms or less or an aryl group with 8 total carbon atoms or less;

R is a carbonyl or sulfonyl group; and

INH is an inhibitor of silver development.

2. The photographic element of claim 1 wherein the 2-substituted-5-amino-1-napthol DIR is located in a red-sensitive layer.

3. The photographic element of claim 2 wherein the cyan dye image-forming unit comprises two or more red sensitive layers and the 2-substituted-5-amino-1-napthol DIR is located in the most red-sensitive layer.

4. The photographic element of claim 1 wherein the film element is a capture or origination element processed with a phenylenediamine developer.

5. The photographic element of claim 1 wherein INH is chosen from the group of mercaptotetrazoles, mercaptothiadiazoles, mercaptotriazoles and mercaptooxadiazoles.

6. The photographic element of claim 5 wherein INH is a mercaptotetrazole.

7. The photographic element of claim 1 wherein INH is a deactivating or self-destructing inhibitor fragment which bears a hydrolyzable group.

8. The photographic element of claim 7 wherein the deactivating or self-destructing inhibitor fragment is a mercaptotetrazole.

9. The photographic element of claim 1 where R has the structure —C(═O)—$(Q)_n$-T where Q represents either an oxygen or nitrogen atom, n is zero or 1 and T is an alkyl or aryl group.

10. The photographic element of claim 1 where R has the structure —$SO_2$-T where T is an alkyl or aryl group.

11. The photographic element of claim 1 wherein the 2-substituted-5-amino-1-napthol DIR is according to Formula (Ia):

Formula (Ia)

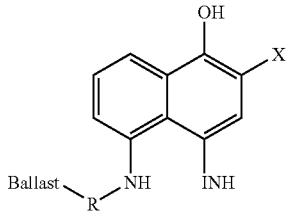

where X is chosen from among hydrogen, halogen atoms, an alkyl group with 6 carbon atoms or less or an N-substituted carbamoyl group where the N substituent is either an alkyl group with 6 carbon atoms or less or an aryl group with 8 total carbon atoms or less;

R is a carbonyl or sulfonyl group;

INH is an inhibitor of silver development; and

Ballast is a ballast group containing at least 8 carbon atoms.

12. The photographic element of claim 11 wherein X is chlorine.

13. The photographic element of claim 11 wherein X is an alkyl group with 6 carbon atoms or less.

14. The photographic element of claim 11 wherein X is a carbamoyl group of the structure —C(═O)NH—Z where Z is chosen from hydrogen, an alkyl group with 6 carbon atoms or less or an aryl group with 8 carbon atoms or less.

15. The photographic element of claim 14 wherein Z is hydrogen.

16. The photographic element of claim 14 wherein Z is ortho-methoxyphenyl.

17. The photographic element of claim 11 wherein the 2-substituted-5-amino-1-napthol DIR is according to Formula (Ic):

Formula (Ic)

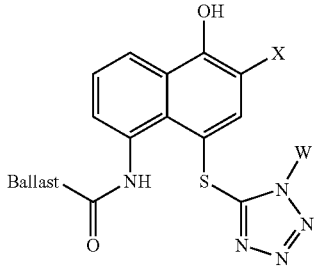

wherein:

Ballast is a group that contains 8 carbon atoms or more;

X is chosen from among hydrogen, halogen atoms, an alkyl group with 6 carbon atoms or less or a N-substituted carbamoyl group where the N substituent is either hydrogen, an alkyl group with 6 carbon atoms or less or an aryl group with 8 total carbon atoms or less; and W is an alkyl or aryl group.

18. The photographic element of claim 17 wherein X is chosen from chlorine, methyl, carbamoyl (—$CONH_2$) or N-(ortho-methoxyphenyl)carbamoyl.

19. The photographic element of claim 18 wherein the 2-substituted-5-amino-1-napthol DIR is chosen from the following:

DIR-3:

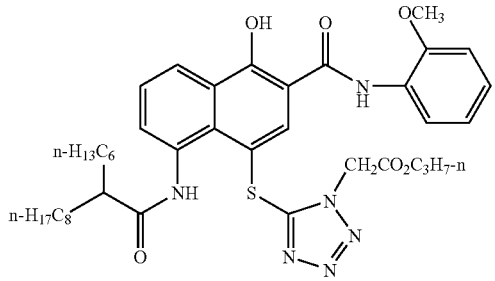

DIR-6:

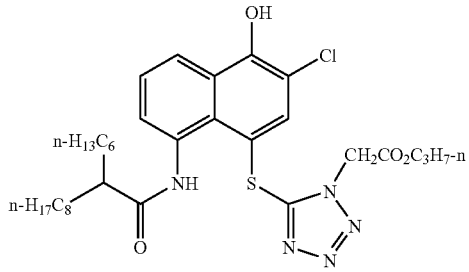

-continued
DIR-8:
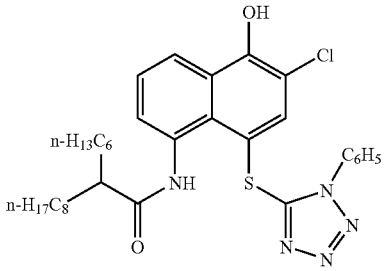
DIR-13:
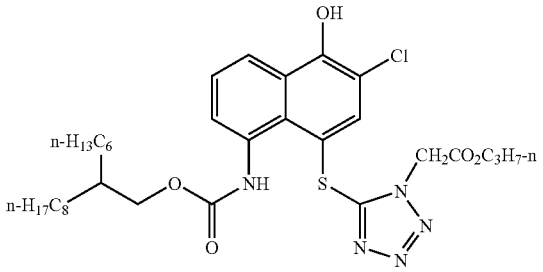
and
DIR-25:
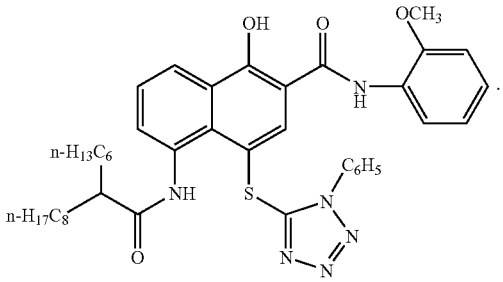
.
* * * * *